US005623993A

United States Patent [19]

Van Buskirk et al.

[11] Patent Number: 5,623,993

[45] Date of Patent: *Apr. 29, 1997

[54] METHOD AND APPARATUS FOR SEALING AND TRANSFERING FORCE IN A WELLBORE

[75] Inventors: Richard G. Van Buskirk; Michael J. Loughlin; Rustom K. Mody, all of Houston; Albert A. Mullins, II, Humble; Michael H. Johnson, Spring, all of Tex.

[73] Assignee: Baker Hughes Incorporated, Houston, Tex.

[ * ] Notice: The term of this patent shall not extend beyond the expiration date of Pat. No. 5,417,285.

[21] Appl. No.: 447,311

[22] Filed: May 22, 1995

Related U.S. Application Data

[63] Continuation-in-part of Ser. No. 258,130, Jun. 10, 1994, Pat. No. 5,417,285, which is a continuation of Ser. No. 926,872, Aug. 7, 1992.

[51] Int. Cl.[6] ..... F21B 33/12

[52] U.S. Cl. ..... 166/292; 166/192; 166/281

[58] Field of Search ..... 166/285, 292, 166/192, 281, 278

[56] References Cited

U.S. PATENT DOCUMENTS

| | | | |
|---|---|---|---|
| 1,627,991 | 5/1927 | Owen | 102/333 |
| 1,979,802 | 11/1934 | Kinley | 102/11 |
| 2,229,325 | 1/1941 | Greene | 166/13 |
| 2,465,564 | 3/1949 | Abrams | 23/230 |
| 3,064,734 | 11/1962 | Toelke | 166/63 |
| 3,231,021 | 1/1966 | Greene | 166/117 |
| 3,233,673 | 2/1966 | Spain et al. | 166/42 |
| 3,262,499 | 7/1966 | Fleming | 166/16 |
| 3,460,625 | 8/1969 | Hart et al. | 166/285 |
| 3,664,421 | 5/1972 | Urbanosky | 166/278 |
| 3,866,681 | 2/1975 | Shirley | 166/285 |
| 4,491,178 | 1/1985 | Terrell et al. | 166/192 |
| 4,621,692 | 11/1986 | Mondshine | 166/281 |
| 4,913,233 | 4/1990 | Fitzgibbon | 166/285 |
| 4,919,989 | 4/1990 | Colangelo | 428/65 |
| 5,095,983 | 3/1992 | Magnani | 166/292 |
| 5,417,285 | 5/1995 | VanBuskirk et al. | 166/242 |

FOREIGN PATENT DOCUMENTS

| | | | |
|---|---|---|---|
| 1113820 | 4/1956 | France . | |
| 2079348 | 2/1981 | United Kingdom | E21B 33/134 |

OTHER PUBLICATIONS

PCT International Search Report, International Application No. PCT/US93/09399, dated 29 Jun. 1994.

Steven D. Moore, *"Thru–Tubing Inflatables Find Workover Niche"*.

*Primary Examiner*—William P. Neuder

*Attorney, Agent, or Firm*—Melvin A. Hunn, Esq.; Mark D. Perdue, Esq.

[57] ABSTRACT

A wellbore is at least partially obstructed with a partition or obstruction member. A fluid slurry of an aggregate mixture of particulate matter is pumped into the wellbore adjacent the partition or obstruction member. The aggregate mixture of particulate material contains at least one component of particulate material, and each of the at least one particulate material components has an average discrete particle dimension different from that of the other particulate material components. Fluid pressure then is applied to the aggregate material and fluid is drained from the aggregate material through a fluid drainage passage in the partition or obstruction member. The fluid pressure and drainage of fluid from the aggregate mixture combined to compact the aggregate mixture into a substantially solid, load-bearing, force-transferring, substantially fluid-impermeable plug member, which seals a first wellbore region from fluid flow communication with a second wellbore region. The plug member is easily removed from the wellbore by directing a high-pressure fluid stream toward the plug member, thereby dissolving or disintegrating the particulate material of the plug member into a fluid slurry, which may be circulated out of or suctioned from the wellbore.

37 Claims, 19 Drawing Sheets

| TEST | MIXTURE A - B - C - D | MILLIDARCIES |
|---|---|---|
| 1 | 00 - 00 - 00 - 00 | 2000.000 |
| 2 | 60 - 20 - 20 - 00 | 66.000 |
| 3 | 80 - 10 - 10 - 00 | 415.000 |
| 4 | 60 - 30 - 10 - 00 | 233.000 |
| 5 | 60 - 10 - 30 - 00 | 51.000 |
| 6 | 40 - 30 - 30 - 00 | 50.000 |
| 7 | 60 - 20 - 15 - 05 | 0.064 |
| 8 | 60 - 15 - 15 - 10 | 0.063 |
| 9 | 60 - 20 - 15 - 05 | 0.081 |

A = 20/40 MESH SAND
B = 100 MESH SAND
C = 200 MESH SAND
D = BENTONITE "GEL" (CLAY)

FIG. 5

METHOD AND APPARATUS FOR SEALING AND TRANSFERING FORCE IN A WELLBORE

CROSS-REFERENCE TO RELATED APPLICATIONS

The present application is a continuation-in-part of:

A. U.S. patent application Ser. No. 08/258,130, filed Jun. 10, 1994, now U.S. Pat. No. 5,417,285 entitled "Method And Apparatus For Sealing And Transferring Force In A Wellbore", further identified by Attorney Docket No. 294-5780-USC, which is a continuation of:

B. U.S. patent application Ser. No. 07/926,872, filed Aug. 7, 1992, "Method And Apparatus For Sealing And Transferring Force In A Wellbore", further identified by Attorney Docket No. 294-5780-US.

A copy of the filing receipt for that application is enclosed.

BACKGROUND OF THE INVENTION

1. Field of the Invention

The present invention relates generally to methods and apparatuses for forming downhole pressure plugs in a wellbore. More particularly, the present invention relates to methods of forming downhole plugs to seal the wellbore and to transfer stress from a wellbore tool to the wellbore itself. Additionally, the invention is directed to the use of particulate matter plugs to either transfer loads or to seal during completion operations.

2. Description of the Prior Art

It is conventional in the oil and gas industry to seal wellbores using packers, bridge plugs, and the like. Typically, a wellbore tool, such as a packer or bridge plug, is run into the wellbore to a desired location therein. The packer or bridge plug is inflated or otherwise actuated into sealing engagement with the wellbore. Such a seal may be effected to separate regions in the wellbore, to contain fluid pressure either above or below the wellbore tool for fracturing or other well treatment operations, or other conventional reasons.

Conventional wellbore tools have a force threshold beyond which the wellbore tool will fail mechanically, or will lose gripping and sealing engagement with the wellbore, which tends to cause undesirable movement of the wellbore tool within the wellbore. The force threshold typically is defined in terms of a maximum or limiting differential pressure across the wellbore tool that the wellbore tool can withstand without failure or movement in the wellbore.

If the force threshold is exceeded, mechanical failure of the wellbore tool or undesirable movement of the wellbore tool may result. Mechanical failure may result in at least partial inoperability of the wellbore tool. If the wellbore tool is rendered inoperable, the wellbore may be undesirably obstructed, requiring expensive fishing remedial operations. Mechanical failure at least will require expensive and time-consuming repair or replacement of the wellbore tool.

Even if the wellbore tool does not fail and is not otherwise damaged, the wellbore tool may be moved or displaced within the wellbore if the force threshold is exceeded. Such movement or displacement is undesirable because the positioning of the wellbore tool within the wellbore frequently is of great importance;. Also, movement or displacement of the wellbore tool could damage other wellbore tools or the producing formation itself, thereby necessitating fishing, workover, or other remedial wellbore operations.

In secondary recovery operations, such as formation fracturing, reliable and dependable packers and bridge plugs frequently are necessary. Many secondary recovery operations require sealing off or packing a selected formation interval, and introducing extremely high pressure fluids into the selected interval. High-pressure fluids exert extreme axial forces on the packers or bridge plugs used to seal off the interval. Thus, the possibility of exceeding the force threshold of such wellbore tools is very great in formation fracturing, and requires the use of expensive, reinforced, high-pressure rated wellbore tools. High-pressure wellbore tools typically have relatively large cross-sectional diameters, precluding their use in through-tubing operations or operations in otherwise reduced-diameter or obstructed wellbores.

An alternative to high-pressure rated wellbore tools is to plug or seal the wellbore with cement. Cement plugs have a number of drawbacks. Expensive and specialized cementing equipment usually is required to pump cement into the wellbore to form a cement plug. Also, a significant time period must elapse to permit a cement plug to harden or set into a sealing or load-bearing cement plug. Another drawback of cement plugs is that they are relatively permanent, and require expensive and time-consuming milling operations to remove them from the wellbore.

During wellbore completion operations, a variety of wellbore tools are utilized to either transfer loads within the wellbore or to seal flow paths within the wellbore. For example, cement is utilized to secure sections of casing string in a fixed position relative to the borehole. Alternatively, or in supplementation to casing cement, external casing packers are utilized to fix a section of casing in position relative to the borehole. Liner hangers are utilized to seal and couple sections of casing string to one another. Typically, a casing section of radially-reduced dimension is suspended within a larger diameter casing string which is directly above. Generally, liner hangers include a gripping mechanism which allows the weight of the lower string to be transferred laterally to the upper string. Additionally, the liner hangers typically include metal-to-metal or elastomeric sealing elements or a combination of metal-to-metal and elastomeric sealing elements which seal the potential fluid flow path at the junction of the sections of casing strings.

A completion operation typically requires the placement of a tubing string in a concentric position relative to the casing string. Commonly, the tubing string is centralized and fixed in position relative to the casing string by one or more packer elements. Typically, the packers serve the dual purposes of transferring loads laterally and providing a seal in the annular region between the tubing string and the casing string. Also during completion operations, one or more sections of the casing string may be temporarily or permanently plugged to limit or prevent the flow of fluids between particular regions; of the central bore of the tubing string.

In short, a large number of wellbore tools are utilized during completion operations to either transfer load within the wellbore or to provide a seal at a potential fluid flow path. These wellbore tools are generally rather expensive components. Additionally, they are difficult to replace and repair and frequently require the removal or all or a portion of the wellbore tubulars from the wellbore in order to allow workmen to replace a component. When, for example, a tubing string is pulled from a wellbore, the well is typically "killed"; that is, chemical additives are introduced into the well to prevent or limit the flow of hydrocarbons from the wellbore. Oil and gas well operators are generally reluctant to "kill" a well, since there is no guarantee that the well will later resume production at the levels of production prior to the "killing" and work over operations.

SUMMARY OF THE INVENTION

It is one objective of the present invention to provide an apparatus for sealing a wellbore, wherein a first wellbore region is isolated from fluid communication with a second wellbore region.

It is another objective of the present invention to provide a method and apparatus for forming a sealing plug member within a wellbore, wherein the plug member transfers force resulting from pressurized fluid in the wellbore to the wellbore itself, obviating the need for high-pressure rated wellbore sealing tools.

It is yet another objective of the present invention to provide a method and apparatus for sealing a wellbore with a plug member that is both strong and substantially fluid-impermeable, yet is easily and quickly removable from the wellbore using conventional wellbore tools.

These and other objectives of the present invention are accomplished by at least partially obstructing a wellbore with a partition or obstruction member. A fluid slurry of an aggregate mixture of particulate matter is pumped into the wellbore adjacent the partition or obstruction member. The aggregate mixture of particulate material contains at least one component of particulate material, and each of the at least one particulate material components has an average discrete particle dimension different from that of the other particulate material components. Fluid pressure then is applied to the aggregate material and fluid is drained from the aggregate material through a fluid drainage passage in the partition or obstruction member. The fluid pressure and drainage of fluid from the aggregate mixture combined to compact the aggregate mixture into a substantially solid, load-bearing, force-transferring, substantially fluid-impermeable plug member, which seals a first wellbore region from fluid flow communication with a second wellbore region. The plug member is easily removed from the wellbore by directing a high-pressure fluid stream toward the plug member, thereby dissolving or disintegrating the particulate material of the plug member into a fluid slurry, which may be circulated out of or suctioned from the wellbore.

Preferably, the aggregate mixture of particulate matter contains a binder component comprising a finely dispersed particulate material which is capable of hydrating and swelling to fill pores or interstitial spaces between other particulate material components of the aggregate mixture of the plug member.

It is another objective of the present invention to utilize the particulate matter pressure plug in otherwise conventional completion operations in order to either transfer loads within the well or seal fluid flow paths within the well. In some applications, the particulate matter pressure plug may serve both functions simultaneously.

Other objects features and advantages of the present invention will become apparent to those skilled in the art with reference to the drawings and detailed description, which follow.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 5 is a table illustrating the results of permeability tests performed on various mixtures and aggregate mixtures for use in forming a plug member according to the present invention;

DETAILED DESCRIPTION OF THE INVENTION

Figure 1:
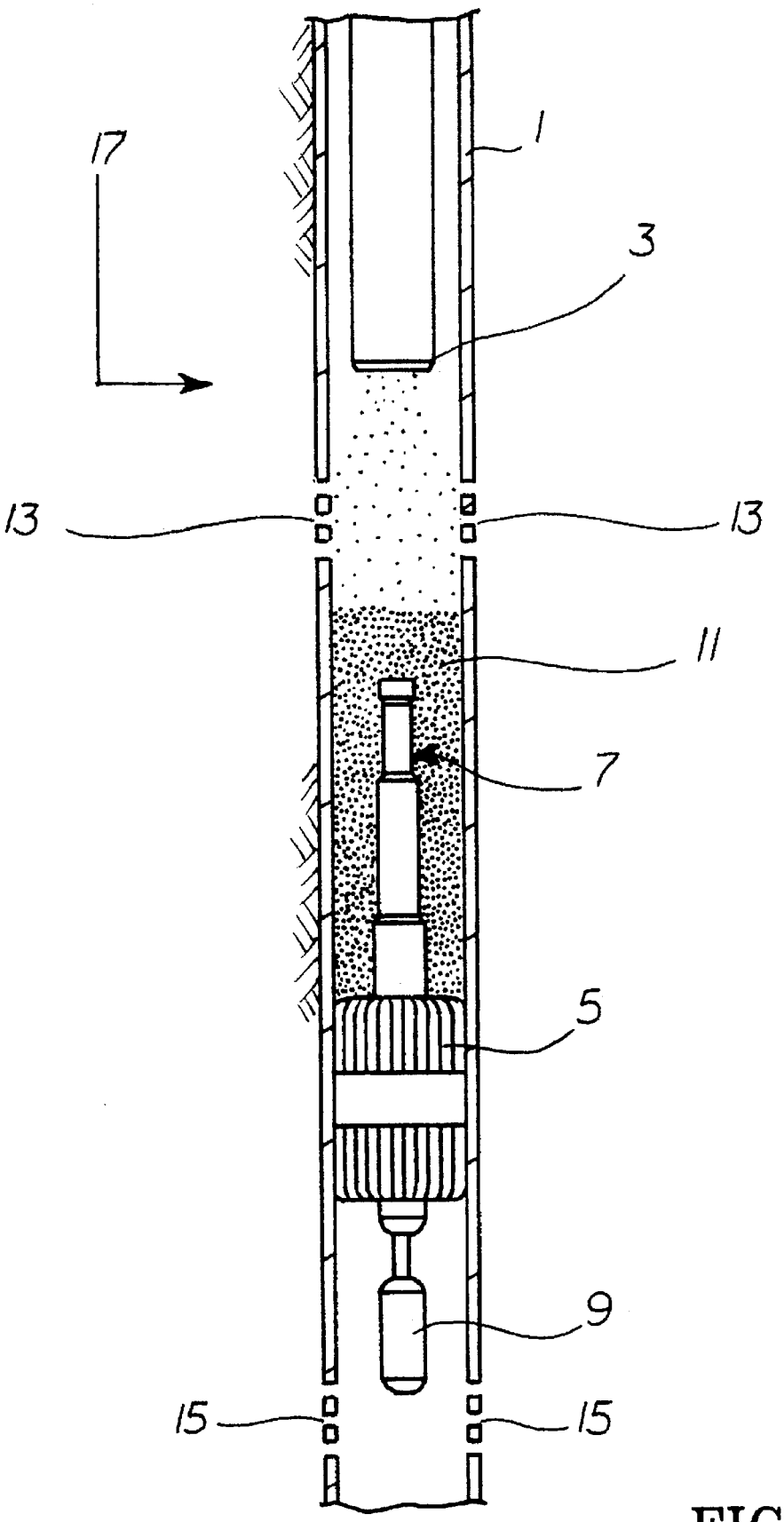
FIG. 1 illustrates, in partial longitudinal section, a wellbore including the apparatus according to the present invention.

Referring now to the figures, and specifically to FIG. 1, a preferred embodiment of the wellbore apparatus according to the present invention will be described. FIG. 1 illustrates, in partial longitudinal section, a wellbore 1. Wellbore 1 is shown as a cased wellbore, but the present invention is contemplated for use in open wellbores, production tubing, or the like, having conduit or a fluid passageway therethrough in which a pressure-tight seal may be advantageous. Wellbore 1 is provided with a source of axial force, in this case a workstring 3. In the case of workstring 3, the source of axial force is fluid pressure, but may be any other source of axial force. A removable partition or obstruction member 5 is disposed in wellbore 1. In this case, partition or obstruction member is an inflatable packer 5. However, the obstruction or partition member may be any sort of wellbore tool that is capable of selectively, and at least partially obstructing fluid flow from a first region of wellbore 1 from a second region. Inflatable packer 5 is provided at an upper extent with a screen filter assembly 7, and at a lower end with fluid outlet 9. The utility and function of screen filter 7 and fluid outlet 9 will be described hereinafter.

A pressure plug or plug member 11 according to the present invention is disposed adjacent to and above inflatable packer 5. Plug member 11 comprises a compacted aggregate mixture of particulate matter. Plug member 11 provides a substantially fluid-impermeable seal in wellbore 1, and thereby isolates a first region of wellbore 1 from fluid flow communication with a second region. Further, plug member 11 serves to transfer axial force from the source of axial force (in this case, fluid pressure from workstring 3) laterally to wellbore 1, thereby permitting use of a lower-pressure rated inflatable packer 5 or other obstruction or partition member.

The specific wellbore operation illustrated in FIG. 1 is a secondary recovery operation, such as formation fracturing. Thus, wellbore 1 is provided with two sets of perforations 13, 15. Each set of perforations 13, 15 and the area defines a region in wellbore 1. In secondary recovery operations, it may be advantageous to isolate one set of perforations, in this case upper set 13, from another set of perforations, in this case lower set 15, so that secondary recovery operations can be directed to only one formation through a single set of perforations 13. The secondary recovery operation illustrated in FIG. 1 is known conventionally as fracturing the formation. In such a fracturing operation, wellbore 1 is packed-off, preferably with a plug member 7 according to the present invention. Workstring 3 then is run into wellbore 1, and fracturing fluid 17, which is conventional, is pumped into wellbore 1, out through perforations 13, and into the formation. Frequently, tremendous pressures are required to force fracturing fluid 17 into the formation. These fluid pressures may be exerted on wellbore 1, plug member 11, and inflatable packer 5. Such a fracturing operation, if employing only an inflatable packer 5 or other wellbore tool, would require inflatable packer 5 to withstand extreme differential pressure, and the resulting axial force, without mechanical failure or movement within wellbore 1. Accordingly, such high-pressure rated inflatable packers 5, as well as other high-pressure rated wellbore tools, are very expensive. Additionally, such wellbore tools generally are larger in diameter, which may preclude their use in through-tubing workover operations.

Plug member 7 is advantageous in that it provides a substantially fluid-impermeable seal in wellbore 1, and transfers axial force (caused in this case by fluid pressure from workstring 3) laterally to the wellbore and away from inflatable packer 5. Therefore, low-pressure rated inflatable packers 5, or other low-pressure rated wellbore tools, can be used in conjunction with plug member 11 according to the present invention and still maintain a substantially fluid-impermeable and strong seal in wellbore 1.

Figure 2:
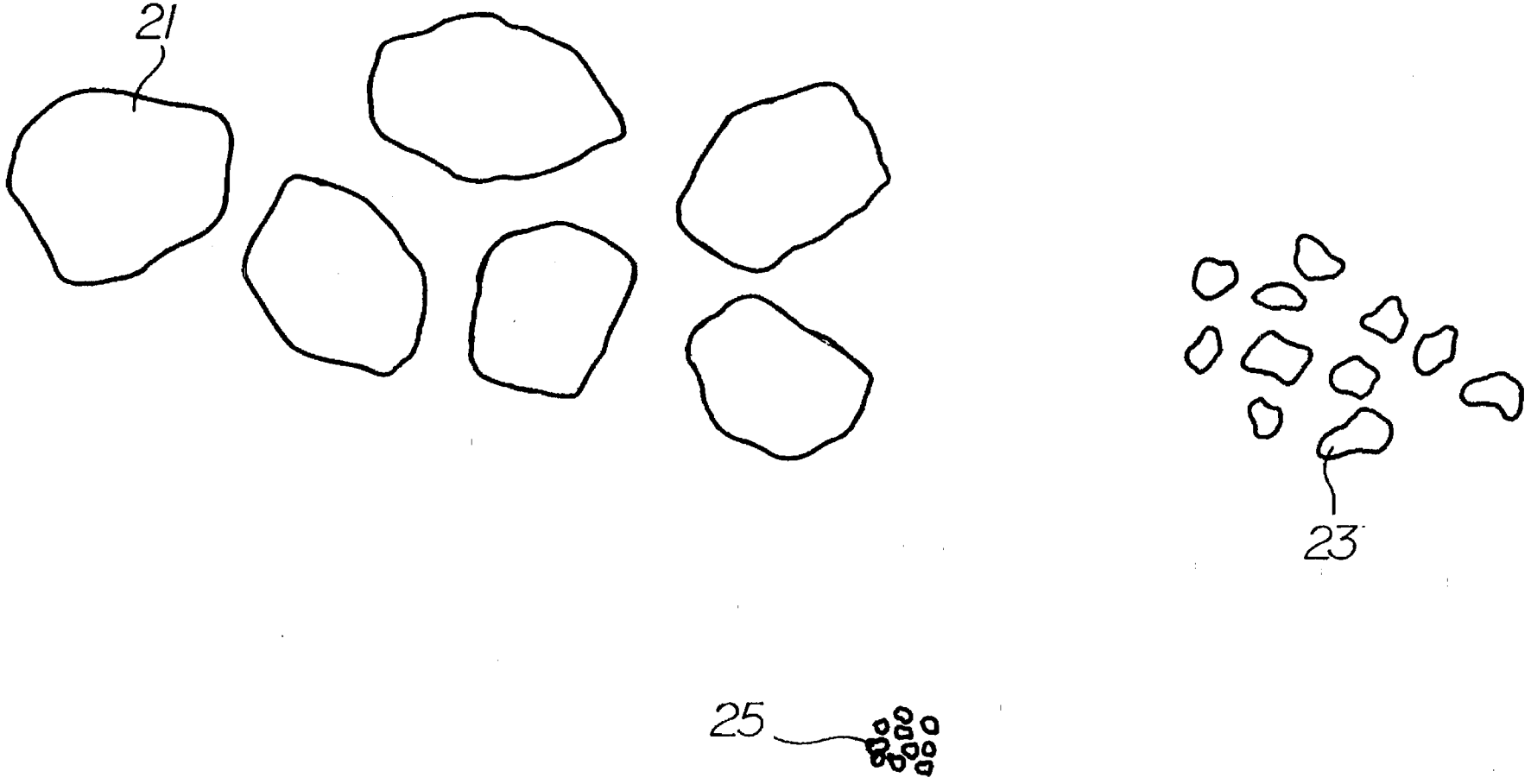
FIG. 2 schematically illustrates relative sizes of the particulate matter that makes up the aggregate mixture, which forms a plug member according to the present invention.

FIG. 2 schematically illustrates the relative sizes of the classes of particulate matter that makes up the aggregate mixture that forms plug member 11 according to the present invention. Preferably, the particulate matter is silica sand, or silicon dioxide. Sand particles 21 schematically represent grains of conventional, coarse 20/40 mesh, sand. The term "mesh" is conventional in the industry and represents an average discrete particle size for particulate materials, particularly sand. Recommended Practice Number 58, entitled "Recommend Practices for Testing Sand Used in Gravel Packing Operations," published by the American Petroleum Institute, Dallas, Texas, is exemplary of the measurement of average discrete particle size of sands. Intermediate sand grains 23 schematically illustrate the size of 100 mesh silica sand, as contrasted to the size of coarse 20/40 mesh silica sand. Fine sand particles 25 schematically illustrate the relative size of 200 mesh sand particles, as contrasted to intermediate 100 mesh sand particles 23 and coarse 20/40 mesh sand particles 21. According to the present invention, an aggregate mixture of silica sand particles of various dimensional classes or mesh sizes is employed to form plug member 11. The use of sand particles 21, 23, 25 of varying average discrete particle dimension is important to forming the substantially fluid-impermeable, force transferring plug member 11 according to the present invention.

Figure 3:
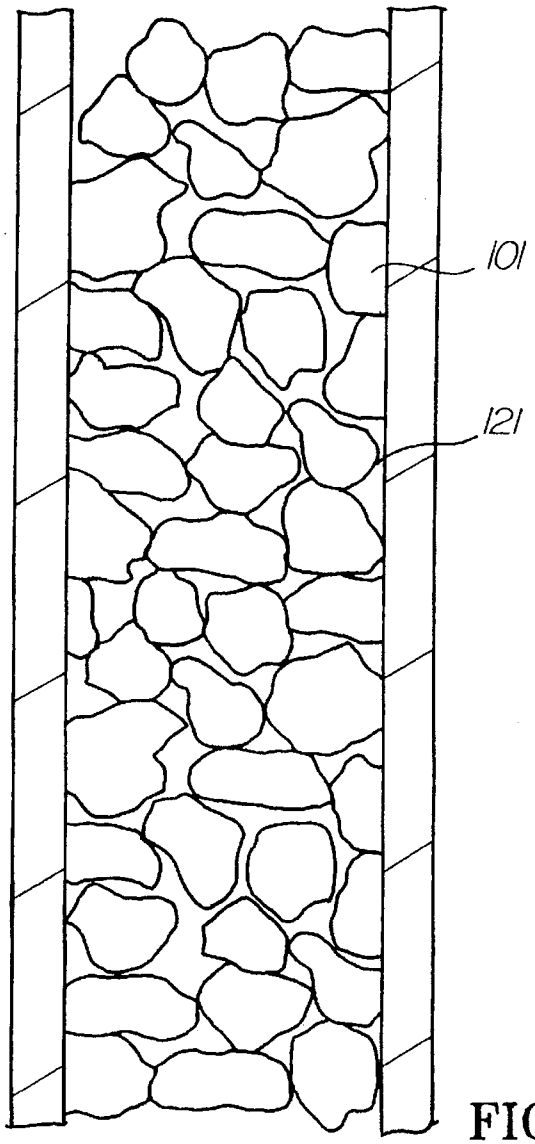
FIG. 3 schematically depicts a wellbore containing coarse sand particles.

FIG. 3 schematically depicts a wellbore 101 containing coarse sand particles 121. Coarse sand particles 121 are schematically depicted as particles of 20/40 mesh silica sand, as illustrated in FIG. 2. As is illustrated, there are numerous pores and interstitial spaces between individual sand particles 121. These pores or interstitial spaces permit the sand to be fluid-permeable, and also provide room for individual sand particles 121 to displace relative to each other in response to forces applied to the sand.

Figure 4:
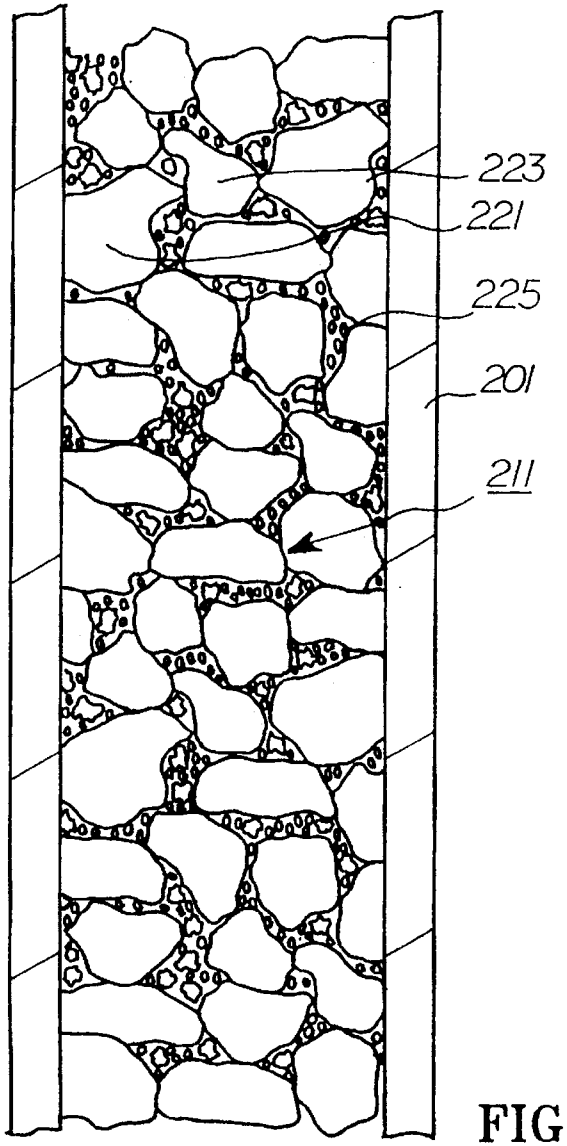
FIG. 4 illustrates; a wellbore containing an aggregate mixture in accordance with the present invention.

FIG. 4 illustrates a wellbore 201 containing a plug member 211 in accordance with the present invention. Plug member 211 comprises an aggregate mixture of coarse, 20/40 mesh sand particles 221, intermediate, 100 mesh sand particles 223, and fine, 200 mesh sand particles 225. As is illustrated, the aggregate mixture of coarse, intermediate, and fine sand particles cooperate to reduce the volume of pores and interstitial spaces between the various sand particles 221, 223, 225. Such an aggregate mixture results in a more substantially fluid-impermeable plug member 211, and provides less space for individual sand grains to displace and move in response to forces exerted on plug member 211.

FIG. 5 is a table illustrating the results of permeability tests performed on various mixtures and aggregate mixtures for use in forming plug member 11, 211 according to the present invention. In the left hand column is a number assigned to each test performed. The central column indicates the volumetric or weight percentage of each component making up the aggregate mixture, wherein component A is 20/40 mesh silica sand (illustrated as 21 in FIG. 2, 121 in FIG. 3, and 221 in FIG. 4), component B is 100 mesh silica sand (illustrated as 223 in FIG. 4), component C is 200 mesh silica sand (illustrated as 225 in FIG. 4), and component D is a bentonite or clay "gel." the right hand column indicates the measured or estimated fluid permeability of the mixture or aggregate mixture tested, in millidarcies. The Darcy is a unit of fluid permeability of materials, which is determined according to Darcy's law, which follows:

$$K=\frac{Q\mu L}{PA}$$

wherein,

P=pressure across sand (in bars);

μ=dynamic viscosity of fluid (in centipoise);

A=cross-sectional area of sand (in square centimeters);

L=length of sand column (in centimeters);

Q=volume flow rate of effluent from sand column (in milliliters per second); and K=permeability (in centimeters per second).

Accordingly, each aggregate sand mixture tested was formed into a column of known length L, and known cross-sectional area A. A fluid having a known dynamic viscosity p, in this case water, was placed at one end of the sand column at a known pressure P. At an opposite end of the column, the flow rate of fluid effluent through the column Q was measured. The foregoing known and measured data was inserted into the above-identified mathematical statement of Darcy's law, and a permeability K was obtained in millidarcies. For test number one, a sand column of 100% 20/40 mesh sand was tested, and yielded an estimated permeability of 2,800 millidarcies. As a second test, an aggregate mixture containing 60% by volume 20/40 mesh sand, 20% by weight 100 mesh sand, and 20% by weight 200 mesh sand was tested, and yielded a permeability of 66 millidarcies. As a third test, an aggregate mixture of 80% by weight 20/40 mesh sand, 10% by weight, 100 mesh sand, and 10% by weight 200 mesh sand was tested and yielded a permeability of 415 millidarcies. As a fourth test, an aggregate mixture of 60% by weight 20/40 mesh sand, 30% by weight 100 mesh sand, and 10% by weight 200 mesh sand was tested and yielded a permeability of 233 millidarcies. As a fifth test, an aggregate mixture of 60% by weight 20/40 mesh sand, 10% by weight 100 mesh sand, and 30% by weight 200 mesh sand was tested and yielded a permeability of 51 millidarcies. As a sixth test, an aggregate mixture of 40% by weight 20/40 mesh sand, 30% by weight 100 mesh sand, and 30% by weight 200 mesh sand was tested and yielded a permeability of 50 millidarcies.

Test numbers 7, 8 and 9 reflect aggregate mixtures that are preferred for use in forming plug member 11, 211 according to the present invention. The aggregate mixtures tested in tests 7, 8 and 9 contain a fourth or binder component, five to ten percent by weight of bentonite. Bentonite is a rock deposit that contains quantities of a desirable clay mineral called montmorillonite. Montmorillonite is a colloidal material that disperses in fluid or water into individual, flat, plate-like clay crystals with dimensions ranging between about five and five hundred millimicrons. The flat plate-like clay crystals presumably overlap each other very tightly to produce a generally substantially fluid-impermeable structure. Additionally, montmorillonite crystals "hydrate" in water, wherein water molecules bond to the crystals, causing the crystals to swell to enlarged dimensions, which may further obstruct pores or interstitial spaces between coarser particles. Bentonite or bentonitic clays are interchangeable terms for any clay-like material possessing the properties discussed herein.

The addition of a binder of bentonite or bentonitic clay material to the aggregate mixtures described herein results in an aggregate mixture having an extremely low fluid permeability. It is believed that the microscopic nature of the clay particles, combined with their ability to hydrate and swell, permits the clay particles to fill and almost completely obstruct any pores or interstitial spaces remaining in an aggregate sand mixture (as illustrated in FIG. 4). This theory is borne out by the test results in tests 7, 8, and 9. For test 7, an aggregate mixture of 60% by weight 20/40 mesh sand, 20%, by weight 100 mesh sand, 15% by weight 200 mesh sand, and 5% by weight of bentonite material was tested and yielded a permeability of 0.064 millidarcies. For test number 8, an aggregate mixture of 60% by weight 20/40 mesh sand, 15% by weight 100 mesh sand, 10% by weight 200 mesh sand, and 15% by weight of bentonite material was tested, and yielded permeability of 0.063 millidarcies. For a ninth and final test, an aggregate mixture of 60% by weight 20/40 mesh sand, 20% by weight 100 mesh sand, 15% by weight 200 mesh sand, and 5% by weight bentonite material was tested and yielded a permeability of 0.081 millidarcies.

From the foregoing test results, trends indicating preferred compositions of aggregate mixtures for use in forming plug member 11, 211 according to the present invention can be noted. Marked decreases in fluid permeability are obtained by adding significant quantities of fine sand particles, such as 200 mesh sand, to a mixture containing coarse sand and intermediate sand components;. A further reduction in permeability is obtained by adding ultra-fine, hydrating particles, such as bentonite or bentonitic clay materials.

Figure 6:
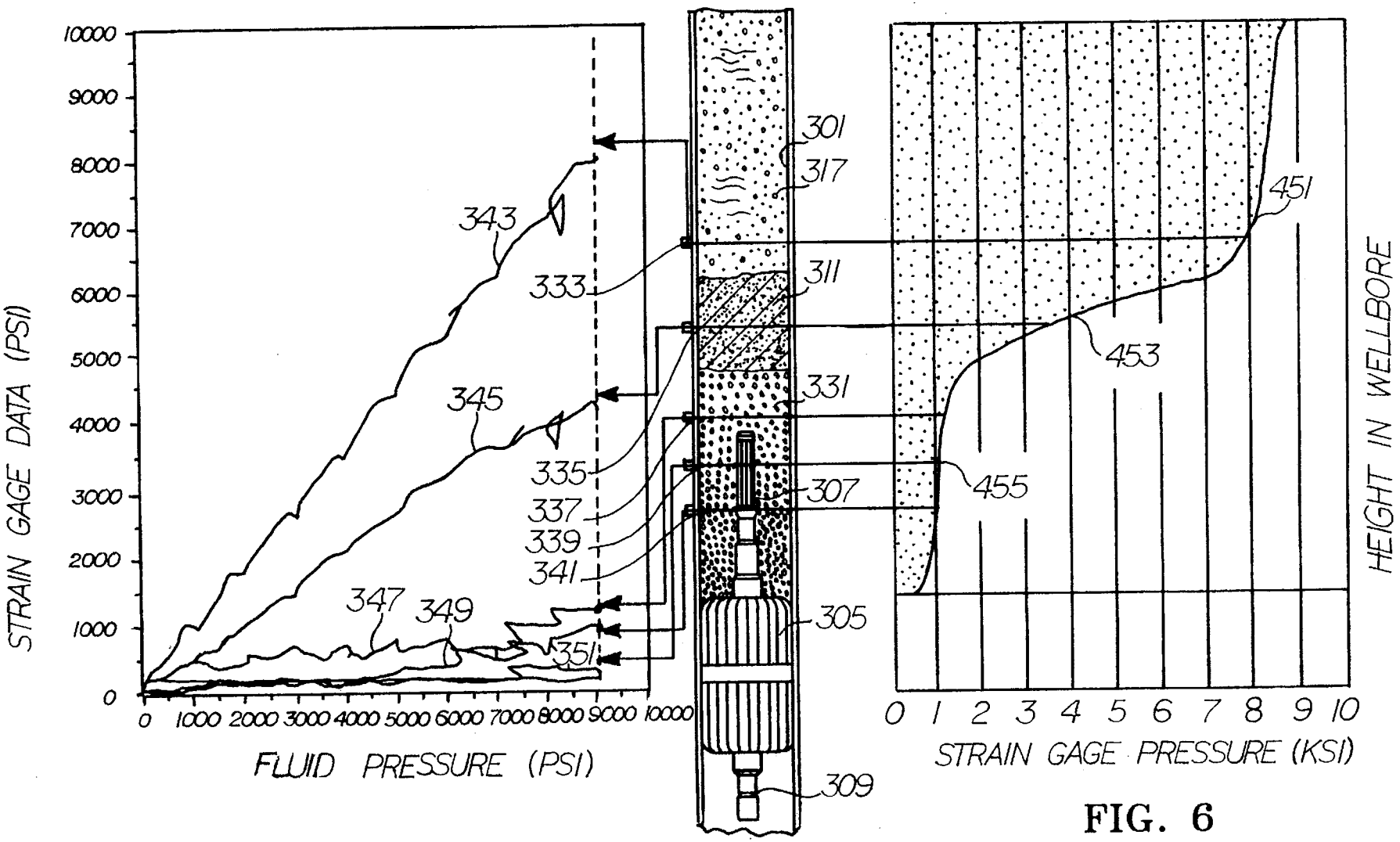
FIG. 6 depicts a superimposition of a pair of graphs of data obtained during testing of a pressure plug or plug member according to the present invention.

FIG. 6 depicts a superimposition of a pair of graphs of data obtained during testing of a pressure plug or plug member 311 according to the present invention. As illustrated in the central portion of FIG. 6, the test rig comprises an artificial wellbore, in this case a length of casing 301, with a partition member, in this case an inflatable packer 305, disposed within wellbore 301. Inflatable packer 305 is further provided with a screen filter 307 at an uppermost end thereof, which is in fluid communication with a fluid exhaust member 309 at a lowermost extent of inflatable packer 305.

Adjacent and atop inflatable packer 305 is column of drainage sand 331 approximately 3 feet in height. Drainage sand 307 is a coarse, preferably 20/40 mesh, silica sand. Because the relatively coarse drainage sand 331 has a significant quantity of pores and interstitial spaces between individual sand particles, 307 will function as a pre-filter for fluid entering screen filter 307 of inflatable packer 305. Such a pre-filter is advantageous to prevent extremely fine particles from entering inflatable packer 305 and tending to cause abrasion and resulting failure of inflatable packer 305.

It is believed to be important to provide either a column of drainage sand, or to maximize the, content (consistent with the desired level of fluid-impermeability) of relatively coarse (20/40 mesh silica sand) particles in the aggregate mixture so that drainage of plug members 11, 211, 311 is enhanced and to facilitate removal of plug member 11, 211, 311, by washout. Without coarse particles, plug member 11, 211, 311 may compact into a rock-like member that cannot be removed easily.

A pressure plug or plug member 311 according to the present invention is formed atop drainage sand 331. According to the preferred embodiment of the present invention, plug member 311 is a column of aggregate mixture as described herein that is twelve inches in height. The preferred aggregate mixture is that described with reference to test number 7 (60% by weight 20/40 mesh silica sand, 20% by weight 100 mesh silica sand, 15% by weight 200 mesh silica sand, and 5% by weight bentonite), having a measured fluid permeability of 0.064 millidarcies.

A quantity of pressurized fluid, in this case water 317, is disposed in wellbore above plug member 311. Pressurized fluid 317 serves as the source of axial force in the illustrated preferred embodiment. Pressurized fluid 317 exerts hydrostatic pressure both in a radial and an axial direction within wellbore 301. Because wellbore 301 typically is extremely strong, and resistant to deformation, the axial force component, which otherwise would act directly on inflatable packer 305, is the quantity of interest for purposes of the present invention.

Wellbore 301 is provided with a number of strain gauges 333, 335, 337, 339, 341, which measure normalized hoop stress in wellbore 301, thereby giving an indication of force transferred through plug member 311 to wellbore 301.

During the test illustrated in FIG. 6, pressurized fluid 317 was stepped-up in pressure in 1,000 pounds per square inch (psi) increments ranging from 0 psi to 9,000 psi. The resulting strain gauge outputs, 343, 345, 347, 349, 351, and implicit force measurements, are plotted over the range of pressure increases in the left hand portion of FIG. 6. The abscissa axis of the left hand graph plots the magnitude of fluid pressure in pressurized fluid 317 in wellbore 301. The ordinate axis of the left hand graph plots hoop stress values measured by stain gauges 333, 335, 337, 339, 341. As is illustrated, strain gauge 333, which is located on an exterior of wellbore 301 at a point in which wellbore 301 is filled with pressurized fluid, shows the largest variation in measured hoop stress 343 as fluid pressure is increased. Strain gauge 335, which is located on the exterior of wellbore 301 where wellbore 301 is obstructed by plug member 311, indicates the second highest change in measured hoop stress 345. Stain gauge 337, which is located on the exterior of wellbore 301 at a point where wellbore 301 is filled with drainage sand 331, but above sand filter 307, measures a hoop stress 347 maximum of approximately 1,000 psi. Strain gauge 339, which is located on the exterior of wellbore 301 at a location where wellbore 301 is filled with drainage sand 331 and sand filter 307, measures a hoop stress 349 maximum of somewhat less than 1,000 psi. Strain gauge 341, which is located on the exterior of wellbore 301 wherein wellbore 301 is filled with drainage sand 331, and is just below screen filter 307 measures a hoop stress 351 maximum of less than 500 psi.

The right hand graph of FIG. 6 depicts the pressure distribution over the length of wellbore 301, from areas filled by pressurized fluid 317 to the top of inflatable packer 305. The abscissa axis of the right hand graph plots measured hoop stress values, and is substantially similar to the ordinate axis of the left hand graph. The ordinate axis of the right hand graph corresponds with the height of wellbore 301 and correlates transfer of force from pressurized fluid 317 through plug member 311 and drainage sand 331, to wellbore 301. As is illustrated, upper right portion 451 of the plotted line is substantially vertical and reflects a relatively uniform pressure distribution in wellbore 301, which is to be expected because, at that point, wellbore 301 is filled with pressurized fluid 317, which exerts a generally uniform hydrostatic pressure on wellbore 301. A central portion 453 of the plotted line indicates a significant measured pressure drop in wellbore 301 where wellbore 301 is occupied by plug member 311 according to the present invention. A lower left portion 455 of the plotted line indicates a fairly steady, maintained low pressure, which averages less than 1,000 psi in wellbore 301. The significant pressure drop in wellbore 301 where it is occupied by plug member 311 according to the present invention indicates that the axial force exerted by pressurized fluid 317 substantially is transferred by sand plug 311 to wellbore 301. Thus, a relatively insignificant axial force load of generally less than 1,000 psi is experienced by drainage sand and inflatable packer 305. Because such a large magnitude of axial force resulting from pressurized fluid 317 in wellbore 301 is transferred to the generally stronger wellbore 301, much weaker and less expensive inflatable packers 305, or other wellbore tools may be employed with plug member 311 according to the present invention to seal a first wellbore region against fluid flow to or from a second wellbore region.

Figure 7:
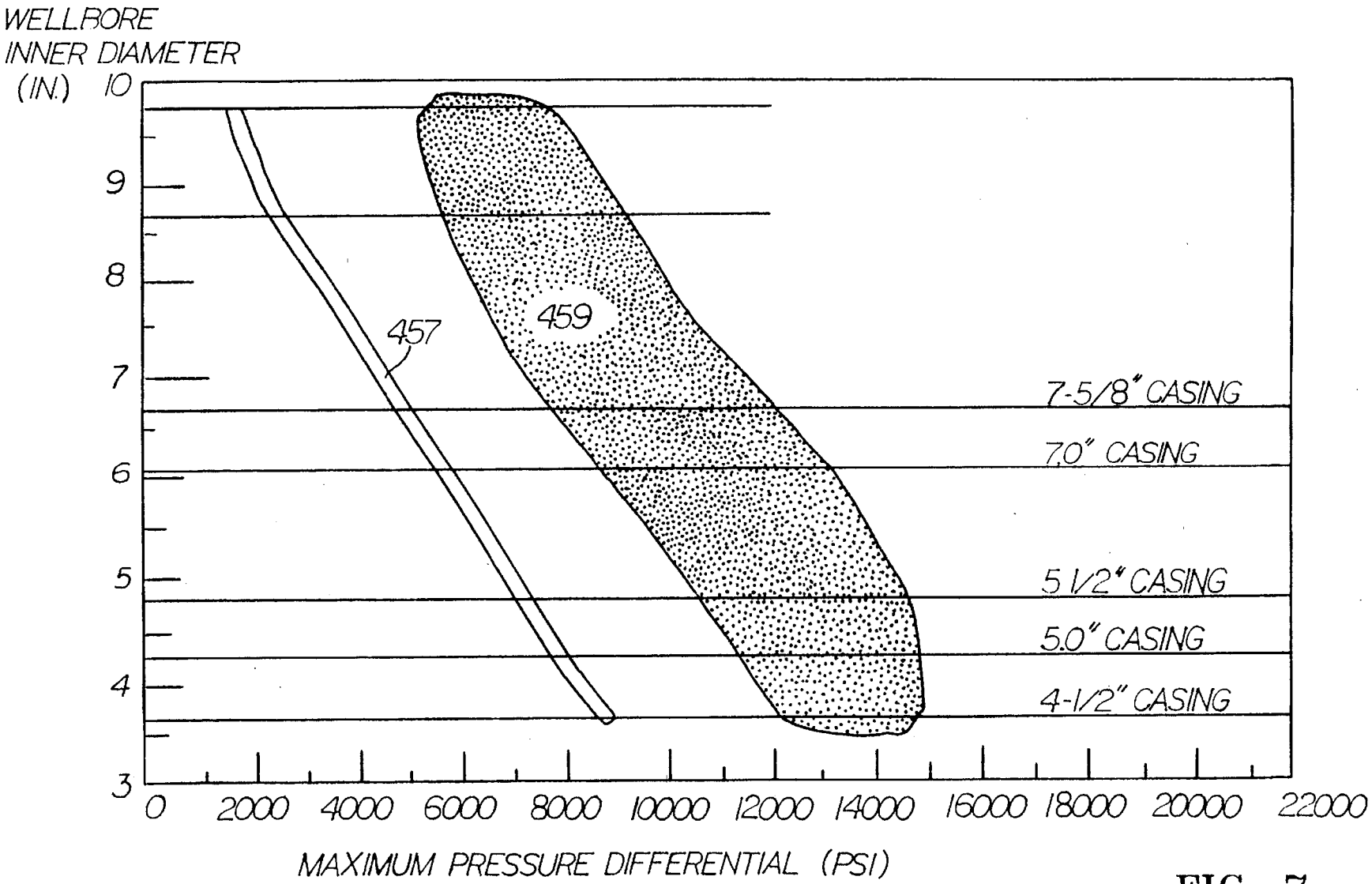
FIG. 7 is a graph comparing the pressure rating of conventional high-pressure rated inflatable packers with the pressure rating of plug member formed according to the present invention.

FIG. 7 is a graph comparing the pressure rating of conventional high-pressure rated inflatable packers (such as 305 in FIG. 6) with the pressure rating of plug member 11, 211, 311 formed according to the present invention. The abscissa axis of the graph plots the values of limiting differential pressure of failure threshold that each type of sealing member can withstand and maintain effective sealing integrity. The ordinate axis plots the casing inner diameter of the wellbore to be sealed. Plotted line 457 represents the pressure rating of a high-pressure rated, 3⅜" outer diameter inflatable packing element. The ability of the packing element to withstand pressure differentials (limiting differential pressure in FIG. 7) is a function of the diameter of the casing or wellbore that the inflatable packer must seal. For small diameter casing, such as 4½" casing, the limiting differential pressure or failure threshold is relatively high at approximately 9,000 psi. However, as the casing or wellbore diameter increases, the inflatable packer must expand further to sealingly engage the casing inner diameter, thus reducing the pressure differential (limiting differential pressure) that it is capable of withstanding. Therefore, for a large diameter casing, such as 10¾ diameter casing, the inflatable packer can only withstand a pressure differential (limiting differential pressure) of approximately 2,000 psi. In contrast, the pressure rating of a plug member 11, 211, 311, according to the present invention is much higher, and is less sensitive to casing diameter than are conventional inflatable packing elements. Area 459 of FIG. 7 represents the pressure rating of plug members 11, 211, 311 formed according to the present invention, as predicted by tests conducted substantially as described with reference to FIG. 6. As is illustrated, in relatively small diameter casing, plug members 11, 211, 311 can withstand pressure differentials (limiting differential pressure) of upwards of 14,000 psi. In larger diameter casing, plug members 11, 211, 311 formed according to the present invention can withstand pressure differentials (limiting differential pressure) of upwards of 5,000 psi. From the data depicted in FIG. 7, it becomes apparent that plug members 11, 211, 311 formed according to the present invention possess significant advantages over conventional inflatable packer elements and other wellbore tools.

Figure 8:
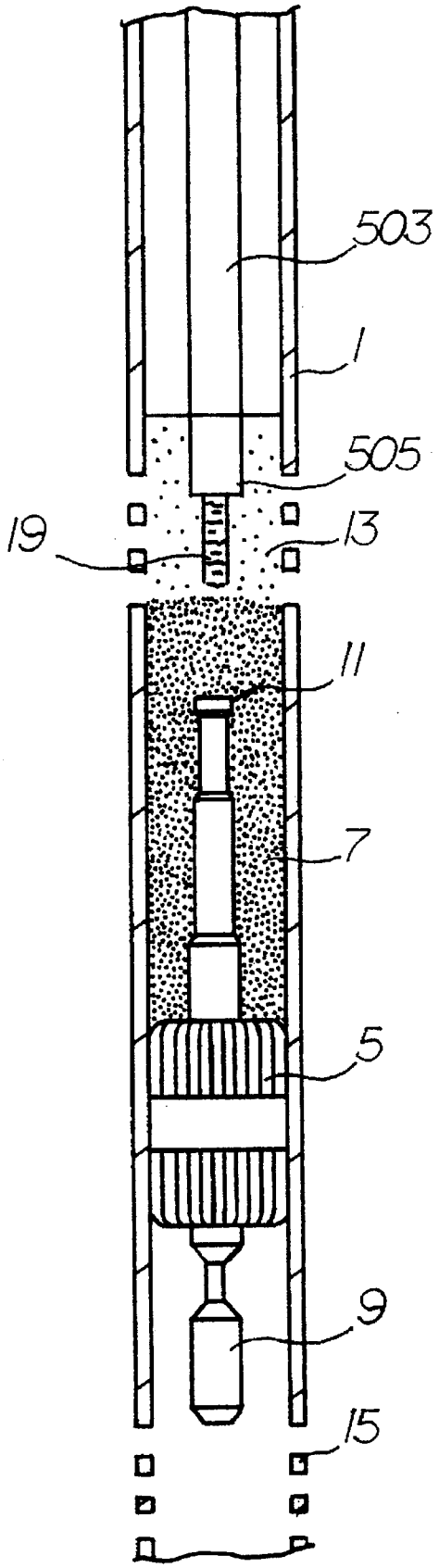
FIG. 8 is a partial longitudinal section view of the sealing and load-bearing apparatus of FIG. 1, the apparatus being shown in a plug member removal or washing-out mode of operation.
Figure 9A:
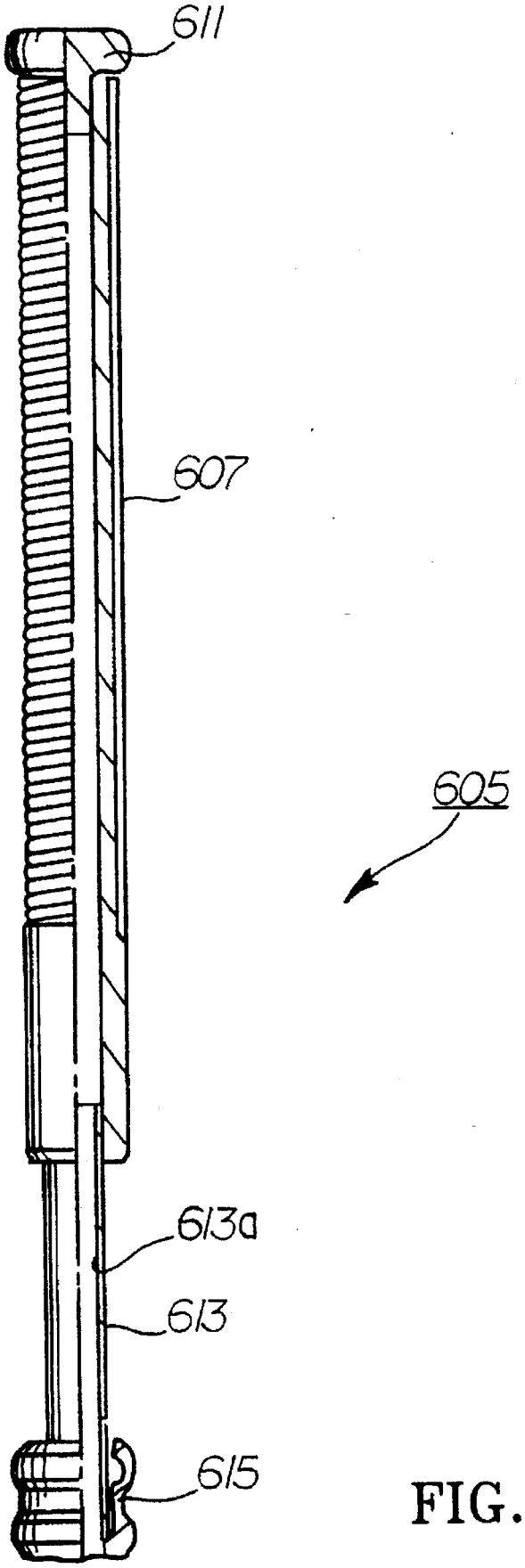
FIGS. 9*a* through 9*e* should be read together and depict a one-quarter longitudinal section view of a partition or obstruction member according to the present invention.
Figure 9B:
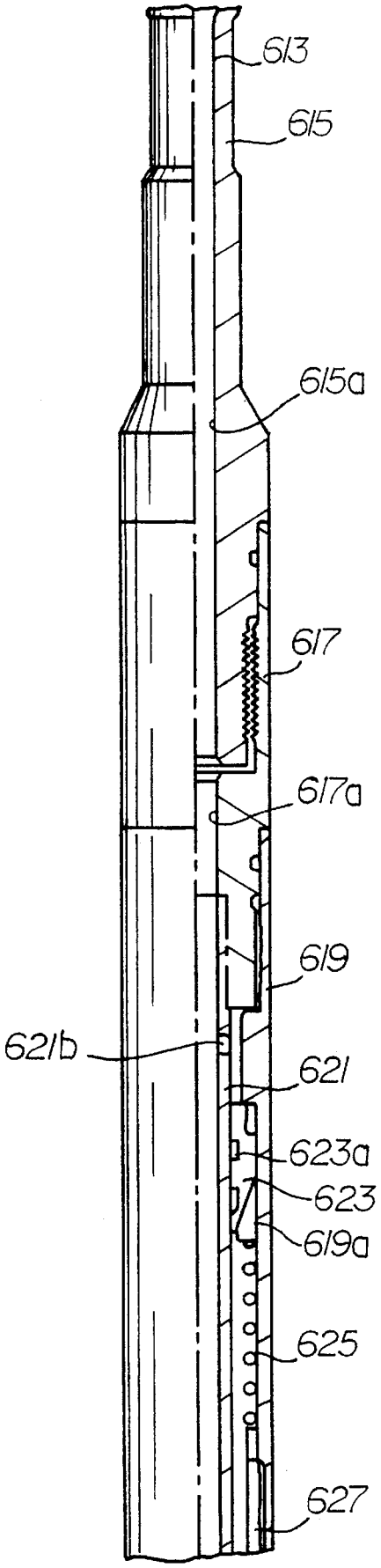
Figure 9C:
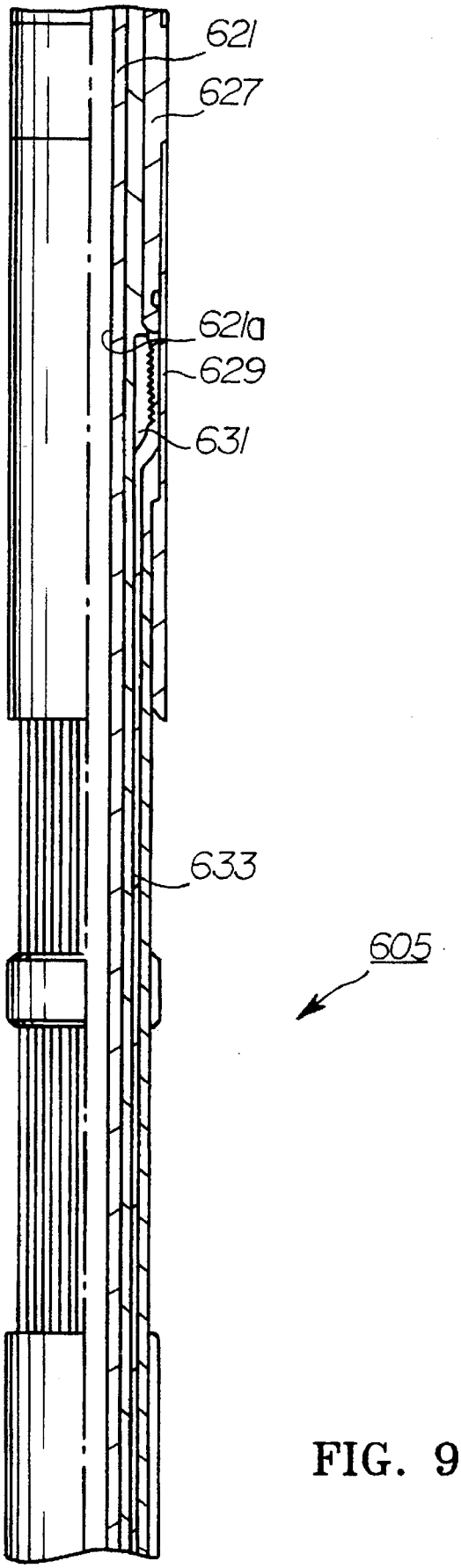
Figure 9D:
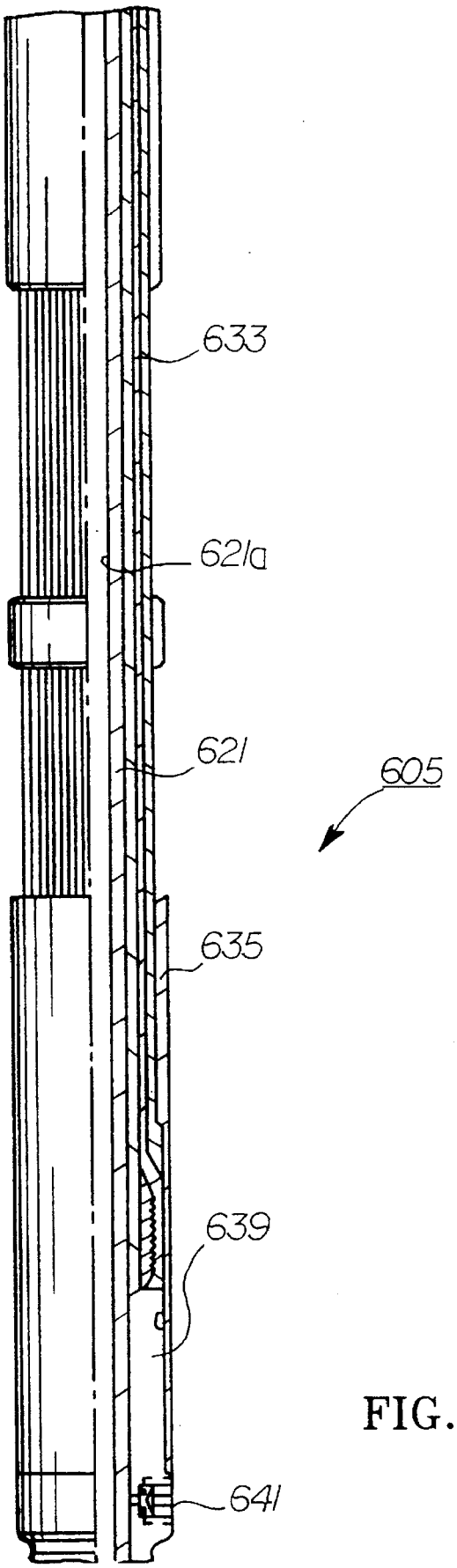
Figure 9E:
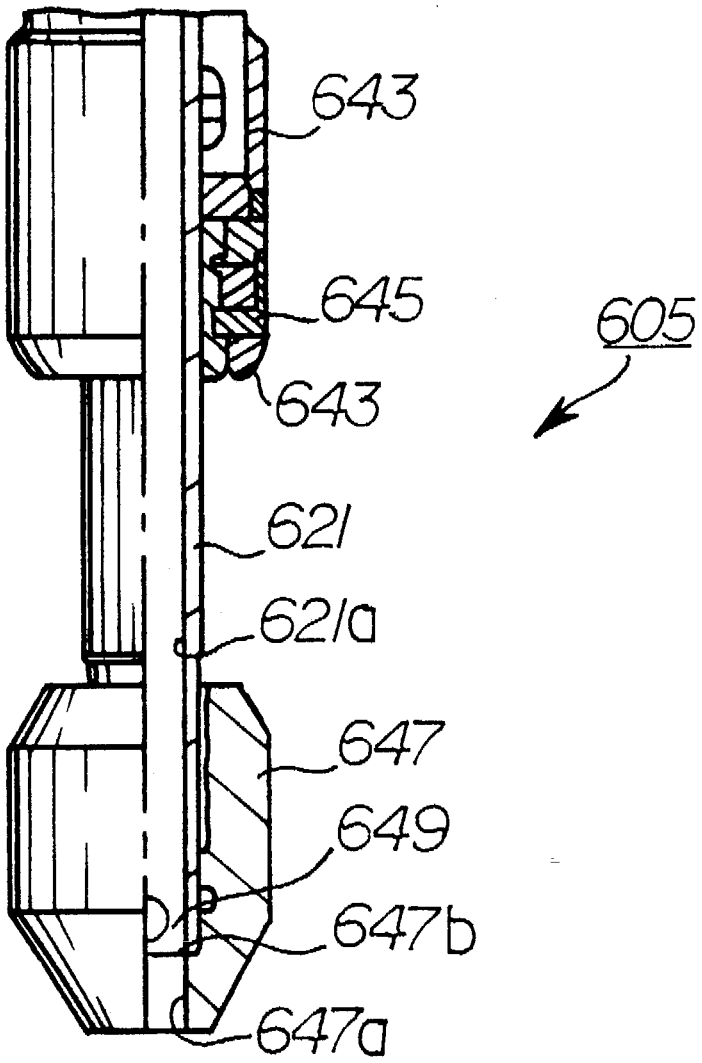

FIG. 8 is a partial longitudinal section view of the sealing and load-bearing apparatus of FIG. 1, the apparatus being shown in a plug member 11 removal or washing-out mode of operation. As in FIG. 1, wellbore 1 has removable partition or obstruction member 5, including screen filter member 7 and fluid exhaust member 9, and plug member 11 disposed therein. Original fracturing workstring 3 is replaced by a circulating or washout workstring 503. Circulating or washout workstring 503 is provided with a nozzle at a terminal end thereof for directing a high-pressure fluid stream 19 toward plug member 11. High pressure fluid stream 19 is provided to dissolve or wash out plug member 11. As is illustrated, the impact of high pressure fluid stream 19 upon plug member 11 causes the particulate matter of plug member 11 to separate into discrete particles. Relatively slow-moving wellbore fluid suspends the particles of particulate matter so that the particulate matter and wellbore fluid 505 may be circulated out of or suctioned from wellbore 1. After plug member 11 is fully disintegrated, inflatable packer member 5 may be conventionally deflated and retrieved. Therefore, plug member 11 according to the present invention, while stronger and capable of bearing more load with excellent sealing integrity, is simply and easily removed from wellbore 1 when its presence is no longer desirable.

FIGS. 9*a* through 9*e*, which should be read together, depict in one-quarter longitudinal section, a partition or obstruction member, in this case an inflatable bridge plug 605, according to the present invention. A screen filter 607 is provided at an uppermost end of bridge plug 605. Screen filter 607 is plugged sit its upper end with plug member 611. A connection tube 613 connects a lower extent of screen filter 607 in fluid communication with fishing neck 615. Fishing neck 615 is provided with a fluid flow conduit 615*a* therethrough for fluid communication with upper element adapter 617. Upper element adapter 617 is connected by threads to fishing neck 615, and is provided with a fluid conduit 617*a* therethrough and is connected by threads to popper housing 619.

A mandrel 621 is connected by threads to upper element adapter 617. Mandrel 621 is provided with a fluid conduit 621*a* therethrough, and also includes a fluid port 621*b*. A poppet 623 is disposed between an exterior of mandrel 621 and an interior of poppet housing 619. Poppet 623 is further provided with a pair of seal members 623*a*. Poppet is biased upwardly by a biasing member or spring 625.

An element adapter 627 is connected by threads to poppet housing 619. Element adapter 627 is connected by threads to an upper element ring 629. Upper element ring 629 cooperates with upper wedge ring 631 to secure a conventional inflatable packer element 633 to element ring 629. Inflatable packer element 633 is conventionally constructed of elastomeric materials and a plurality of circumferentially overlapping flexible metal strips.

A lower element ring 635 is secured to inflatable packing element 633 by lower wedge ring 637. Lower element ring 629 is connected by threads to a lower element adapter 639. Lower element adapter 639 is provided with a threaded bleed port 641, which is selectively opened and closed to bleed air from between mandrel 621 and inflatable packing element 633 during assembly of bridge plug 605. Lower adapter 639 is connected by threads to a lower housing 643. Lower housing 463 is secured to mandrel 621 by means of a shear member 645, which permits relative motion between lower housing 643 and mandrel 621 upon application of a force sufficient to fail shear member 645.

A guide shoe 647 is connected by threads to mandrel 621, and is provided with a fluid conduit 647*a* in fluid communication with fluid conduit 621*a* of mandrel 621. Guide shoe 647 is further provided with a closure member, in this case a ball seat 647*b*, which is adapted to receive a ball 649 to selectively obstruct fluid flow through inflatable bridge plug 605. Preferably, ball seat 647*b* is a pump-through ball seat, which will release ball 649 and permit fluid flow out of bridge plug 605 upon application of fluid pressure of selected magnitude.

In operation, bridge plug 605 according to the present invention is assembled into a workstring (not shown) at the surface of the wellbore (not shown) and is run into the wellbore to a desired location. At the desired location in the wellbore, bridge plug 605 may be set actuated or inflated into sealing engagement with the wellbore by the following procedure.

Pressurized fluid is pumped through workstring and enters bridge plug 605 through screen filter 607. Pressurized fluid flows from screen filter, fluid conduit 613*a* in connection tube 613, through fluid conduit 615*a* in fishing neck 615, through fluid conduit 617*a* of upper adapter 617, and into fluid conduit 621*a* of mandrel 621. Closure member 647*b*, 649, obstructs the fluid conduit in 621*a* in mandrel 621 so that fluid pressure may be increased inside mandrel 621. As fluid pressure increases, fluid flows through port 621*b* into a chamber defined between mandrel 621, upper adapter 617*a*, poppet housing 619, and poppet 623. Responsive to fluid pressure, poppet 623 moves relative to mandrel 621 and poppet housing 619 when the fluid pressure differential acting on poppet 623 exceeds the biasing force of biasing member 625. As poppet 623 moves relative to poppet housing 619, popper 623 moves past a shoulder 619*a* formed in the interior wall of poppet housing 619, wherein pressurized fluid is permitted to flow around poppet 623 and poppet seal member 623*a*. Fluid continues to flow between the exterior of mandrel 621 and inflatable packing element 633 to inflate inflatable packing member 629.

Inflation of inflatable packing element 633 will cause shear member 645 in lower housing 643 to fail, thereby permitting relative movement between mandrel 621 and lower packing element assembly (which includes lower element ring 635, wedge ring 637, lower element adapter 639, and lower housing 643). Inflation of inflatable packer element 633 and relative movement between the lower element assembly and mandrel 621 permits inflatable packing element 633 to extend generally radially outwardly from mandrel 621 and into sealing engagement with a sidewall of the wellbore.

After sealing engagement is obtained, fluid pressure within mandrel 621 may be reduced, which permits biasing member 625 to return poppet 623 to its original position, blocking fluid flow out of the inflation region defined between mandrel 621 and inflatable packing element 631.

Bridge plug 605 described herein is arranged as a permanent bridge plug. Permanent bridge plugs, once set or inflated, cannot be deflated or unset and removed from the wellbore. It is within the scope of the present invention, however, to provide a retrievable bridge plug, which may be selectively inflated and deflated and removed from or repositioned in the wellbore. Such a retrievable bridge plug may be obtained by provision of conventional deflation means to permit selective inflation and deflation of the retrievable bridge plug. Bridge plug 605 according to the present invention provides a drainage passage 621*a*, in fluid communication with drainage sand (331 in FIG. 6) through sand screen 607, and in communication with an exhaust member (guide shoe 649) to provide drainage of fluid from the plug member according to the present invention.

With reference now to FIGS. 1 through 9*e*, the operation of the present invention will be described. The following description is of a through-tubing formation fracturing operation. However, the present invention is not limited in utility to either through-tubing operations or fracturing and other secondary operations.

As a preliminary step, workstring 3 is prepared at the surface with a terminal end or sub adapted for delivering and setting a partition or obstruction member, preferably inflatable packer 5, 605. Partition or obstruction member 5, 605 need not, however, be inflatable packer 5, 605, but could be any sort of wellbore tool adapted to selectively and at least partially obstruct wellbore 1.

Workstring 3 then is run into wellbore 1 to a selected depth or location therein. As illustrated in FIGS. 1 and 8, the selected depth or location in wellbore 1 may be a point between sets of perforations 13, 15, wherein it is advantageous to separate and isolate a first wellbore region or zone proximal to one set of perforations 13 from a second region or zone proximal to a second set of perforations 15. At the selected depth or location in wellbore 1, partition or obstruction member 5, 605 is set and released from workstring 3 in a conventional manner.

For through-tubing operations, it is advantageous that workstring 3 and partition or obstruction member 5, 605 have outer diameters that are as small as possible to facilitate movement of workstring 3 and partition or obstruction member 5, 605 through reduced-diameter production tubing or otherwise obstructed wellbore sections.

According to a preferred embodiment of the present invention, inflatable packer 5, 605 is provided with an elongate screen filter assembly 7, 607, which is in fluid flow communication with a fluid exhaust assembly 9, 647 to provide fluid drainage. Preferably with such an inflatable packer, a slurry of drainage or filter sand is (331 in FIG. 6) deposited adjacent to inflatable packer 5, 605 in a quantity sufficient to fully encase or enclose screen filter member assembly 7, 607. Such a column of drainage sand provides a pre-filter for the screen filter assembly 7, 607, preventing abrasive fines from entering inflatable packer 5, 605 and tending to cause premature mechanical failure of inflatable packer 5, 605. A preferred drainage sand column (331 in FIG. 6) is formed of coarse, 20/40 mesh, silica sand that is pumped into wellbore 11 in a fluid slurry with ordinary fresh water as the slurry fluid.

After partition or obstruction member 5, 605 is set and released, at least partially obstructing wellbore 1, aggregate mixture is prepared at the surface into a fluid slurry. Preferably, the aggregate mixture comprises 60% by weight coarse, 20/40 mesh, silica sand, 20% by weight intermediate, 100 mesh, silica sand, 15% by weight fine, 200 mesh, silica sand, and 5% by weight bentonite or bentonitic material. Preferably, fresh water is used as the slurry fluid to hydrate and disperse bentonitic particles into a colloidal form. The slurry should be sufficiently agitated to ensure dispersion of the bentonitic material.

The aggregate mixture slurry then is pumped through workstring 3 and into wellbore 1 adjacent and atop the drainage sand column. After a sufficient volume of aggregate mixture fluids slurry (a quantity sufficient to produce a column at least 12" in height) is pumped into wellbore 1, pumping should cease. A period of time, preferably greater than five to ten minutes, should elapse to permit the aggregate mixture fluid slurry to settle to a relatively quiescent condition.

After the settling period has elapsed, fracturing operations may be commenced. In a typical fracturing operation, conventional fracturing fluid (17 in FIG. 1 and 317 in FIG. 6) is pumped through workstring 3 into wellbore 1 at a volume flow rate sufficient to achieve the necessary fluid pressure for successful fracturing (typically approaching 10,000 psi). As fluid pressure increases, the axial force exerted by fluid pressure on plug member 11, 211, 311 increases. The increased axial force on plug member 11, 211, 311 compacts plug member 11, 211, 311 and causes drainage of gross water from the aggregate mixture fluid slurry, through drainage sand and drain filter assembly 7, 607, wherein the gross water is exhausted through fluid exhaust assembly below inflatable packer 5, 605. Gross water is fluid contained in the pores or interstitial spaces between sand grains in the aggregate mixture. Gross water is to be distinguished from hydrated water, which comprises small quantities of water that is hydrated or bonded to bentonitic particles. It is extremely advantageous to drain gross water from plug member 11, 211, 311, so that the aggregate mixture can be compacted to a strong, substantially solid and substantially fluid-impermeable plug member 11, 211, 311. Hydrated water is desirable because it maintains bentonitic particles in the hydrated or swelled form, which tends to reduce the fluid permeability of plug member 11, 211, 311.

Thus, a preferred plug member 11, 211, 311 according to the present invention will possess two regions of differing permeability: a solid substantially fluid-impermeable, force transferring region; and a relatively fluid-permeable drainage sand region. Screen filter 7, 607 of inflatable packer 5, 605 permits drainage of gross water from plug member 11, 211, 311 yet prevents significant quantities of the aggregate mixture of plug member 11, 211, 311 or drainage sand 331 from being carried away with the gross water.

As fluid pressure is increased, plug member 11, 211, 311 is compressed and compacted and becomes more substantially fluid-impermeable and stronger. It is believed that plug member 11, 211, 311 according to the present invention employs a "slip-stick" deformation mechanism, which improves the strength and substantial fluid impermeability of plug member 11, 211, 311. It is believed that the combination of coarse, intermediate, and fine sand particles, along with the ultra-fine, hydrated, bentonitic particles, permits plug member 11, 211, 311 to deform continuously as axial forces exerted thereon vary. This continuous deformation, called the slip-stick mechanism, permits plug member 11, 211, 311 to compact into a strong and substantially fluid-impermeable plug that continuously redistributes stresses within itself, thereby avoiding disintegration and failure. During the fracturing operation, the slip-stick mechanism of the aggregate material of plug member 11, 211, 311 permits plug member 11, 211, 311 to seal against fluid pressure loss, and to transfer axial loads, which otherwise would be exerted directly on inflatable packer 5, 605, to wellbore 1, which can more easily bear such extreme loads. Fluid drainage must be provided to permit the aggregate mixture to compact tightly and to achieve the slip-stick deformation mechanism, which cannot be achieved if the content of gross water in the aggregate mixture is excessive.

It should be noted that force transfer away from partition or obstruction member 5, 605 is sufficiently substantial that partition member 5, 605 may be unset or deflated, and plug member 11, 211, 311 will maintain its strength and sealing integrity.

After fracturing operations are complete, plug member 11, 211, 311 may be disintegrated, dissolved, or washed out (substantially as described with reference to FIG. 8) by directing a high-pressure fluid stream 19 from workstring 3. The disintegrated fluid member and fluid may be circulated out of wellbore 1 or suctioned therefrom using a conventional wellbore tool.

Thus, the present invention is operable in a plurality of modes of operation, the modes of operation including: a delivery mode of operation in which an aggregate mixture including particulate matter is conveyed into a wellbore in a fluid slurry form to a position adjacent a partition or obstruction member. Another mode of operation is a compaction mode in which axial force from a source of axial force in the wellbore is applied to the aggregate mixture to compact the aggregate mixture and at least partially form a plug member. Yet another mode of operation is a force-transfer mode in which the plug member transfers force from the source of axial force away from the partition member into the wellbore. Still another mode of operation is a wash-out mode of in which the plug member is disintegrated by application of a stream of high-pressure fluid. Still another mode of operation is a communication mode in which the plug member is disintegrated and the partition member is removed from the wellbore thereby allowing fluid communication between first and second wellbore regions.

The present invention has a number of advantages. One advantage of the present invention is the provision of a strong, substantially fluid-impermeable means for sealing against fluid flow communication between a first and second regions in a wellbore. Another advantage of the present invention is that the force-transfer characteristics of the plug member obviate the need for expensive high-pressure rated partition or obstruction members, such as inflatable packers or bridge plugs. Therefore, through-tubing operations and operations in otherwise obstructed wellbores are facilitated and rendered less costly. Still another advantage of the present invention is that the plug member is formed easily and is disintegrated easily, permitting rapid and efficient workover or secondary recovery operations.

Figure 10A:
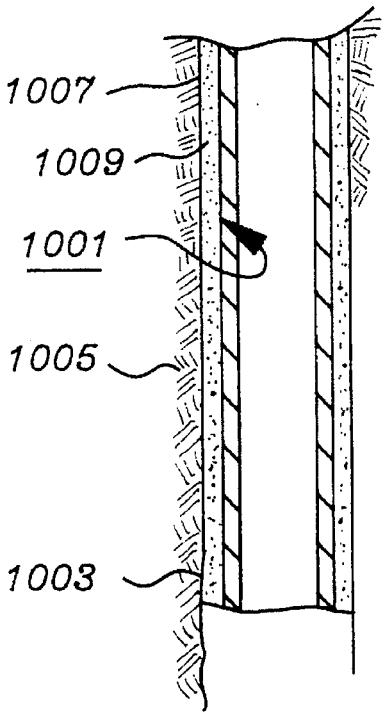
FIGS. 10A through 10N depict utilization of the particulate matter pressure plug of the present invention in otherwise conventional completion operations to either supplement or substitute for completion tools or completion methods.
Figure 10B:
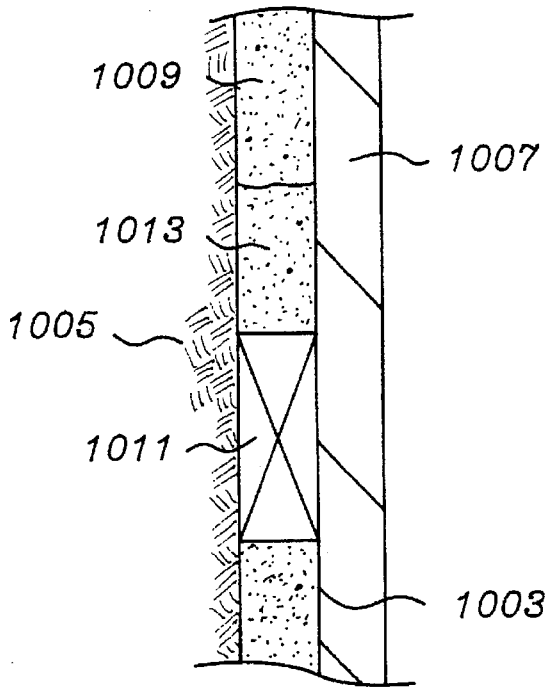
Figure 10C:
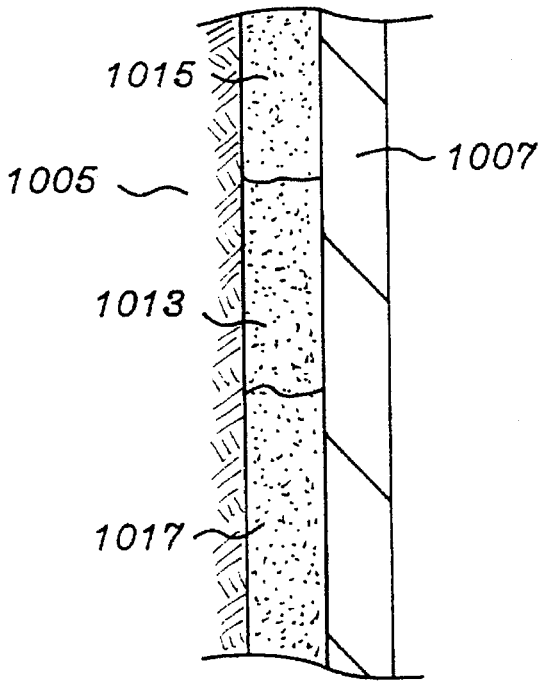
Figure 10D:
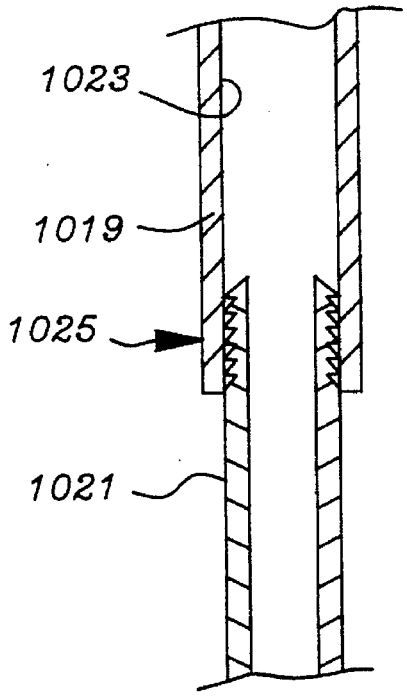
Figure 10E:
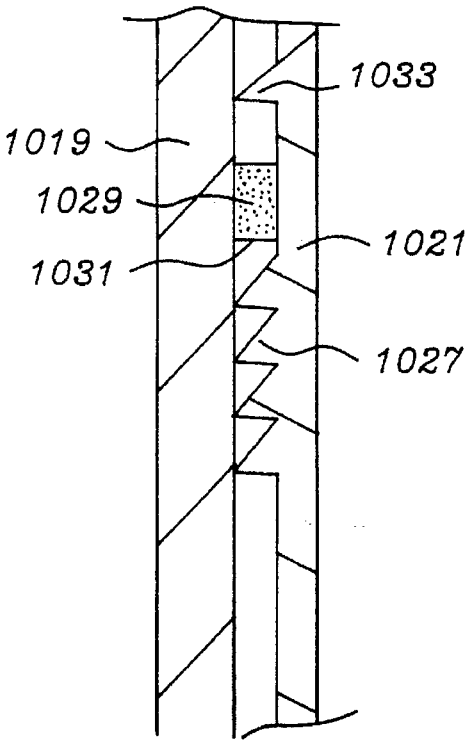
Figure 10F:
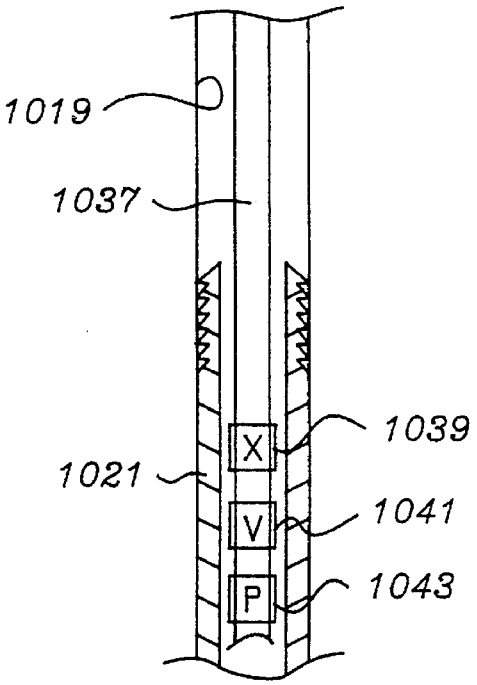

The particulate matter pressure plug of the present invention may be utilized in completion operations in lieu of particular completion tools or processes, or in supplementation of particular wellbore tools and processes. FIGS. 10A through 10N are simplified schematic depictions of particular wellbore completion operations, and will be utilized to provide examples of how the particulate matter pressure plug of the present invention may be utilized in completion operations.

During completion operations, a wellbore 1001 extends from a surface location and is defined by a borehole 1003 which extends downward through earth formations 1005. Most wellbores include a casing string 1007 which is secured in position relative to borehole 1003 by cement 1009. In some situations, all or a portion of the casing string is secured in position relative to the borehole through utilization of external casing packers, such as external casing packer 1011 which is depicted schematically in FIG. 10B. The particulate matter pressure plug 1013 of the present invention may be utilized in combination with cement 1009 and/or external casing packer 1011. In this particular configuration, which is shown in FIG. 10B, the particulate matter pressure plug 1013 is utilized to transfer loads laterally from casing string 1007 to borehole 1003. FIG. 10C depicts particulate matter pressure plug 1013 disposed between upper and lower intervals of cement 1015, 1017, and which facilitates the transfer of loads from casing string 1007 to formation 1005.

During completion operations, sections of radially reduced casing are suspended from larger diameter casing which is disposed above and secured in a fixed position relative to the borehole. This is shown schematically in the view of FIG. 10D. As is shown, lower casing section 1021 is lowered through the central bore 1023 of upper casing section 1019, and secured in position relative to upper casing section 1019 by gripping and sealing assembly 1025, which is shown only schematically in this view. FIG. 10E depicts how the particulate matter pressure plug of the present invention may be utilized with a gripping and sealing assembly 1025 in order to transfer loads laterally from lower casing section 1021 to upper casing section 1019, and to simultaneously seal the potential fluid flow path between upper casing section 1019 and lower casing section 1021.

As is shown in FIG. 10E, particulate matter pressure plug 1029 may be provided in a position intermediate lower casing section 1021 and upper casing section 1019. In the view of FIG. 10E particulate matter pressure plug 1029 is located intermediate metal-to-metal seal 1033 and gripping assembly 1027, both of which are depicted schematically to simplify the drawing. As is shown, particulate matter containment member 1031 is disposed beneath particulate matter pressure plug 1029. Particulate matter pressure plug 1029 operates to transfer load laterally from lower casing section 1021 to upper casing section 1019, in supplementation of the load transference which occurs through gripping assembly 1027. Additionally, particulate matter pressure plug 1029 may be utilized to seal the potential fluid flow path between lower casing section 1021 and upper casing section 1019, in supplementation of the metal-to-metal seal 1033.

Typically, during completion operations, a workstring (or alternatively a production tubing string) is lowered within the casing string to a desired location. The workstring typically includes one or more perforating guns, one or more; valves, and one or more packers, which cooperate to allow for the selective perforation and testing of particular formations. In general terms, the packers are utilized to isolate an annular region between the workstring and the casing string in a region of interest. The perforating gun or guns are utilized to perforate a particular section or sections of the casing string to allow the flow of fluids such as formation water, oil, and gas from the formation into the annular region. The fluids are allowed to pass through one or more valves into the workstring, where they are drawn to the surface and analyzed. Subsequent to the well testing operations, a production tubing string is lowered into position within the casing string, and packers are set to centralize, stabilize, and locate the production tubing string relative to the casing string, as well as to seal particular annular regions. Then one or more valves are open to allow production of the fluid from the annular region to the central bore of the production tubing string. These operations are shown collectively and schematically in FIG. 10F. As is shown, a workstring or production tubing string 1037 is lowered within casing string which is composed of upper casing section 1019 and lower casing section 1021. The workstring of production tubing string includes a packer 1039, a valve 1041, and a perforating gun 1043, all of which are depicted schematically.

Figure 10G:
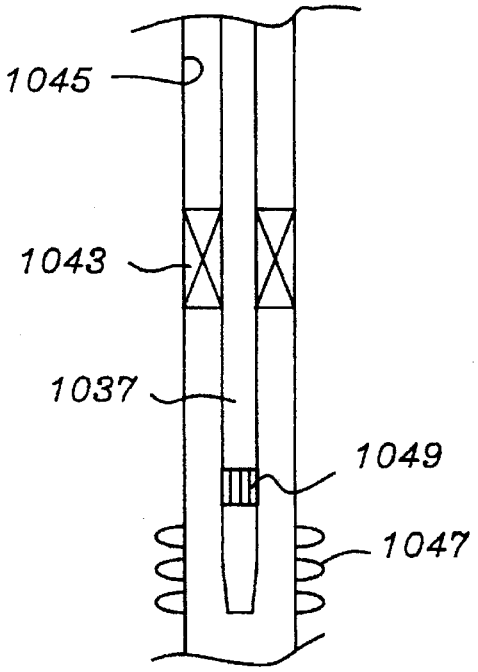
Figure 10H:
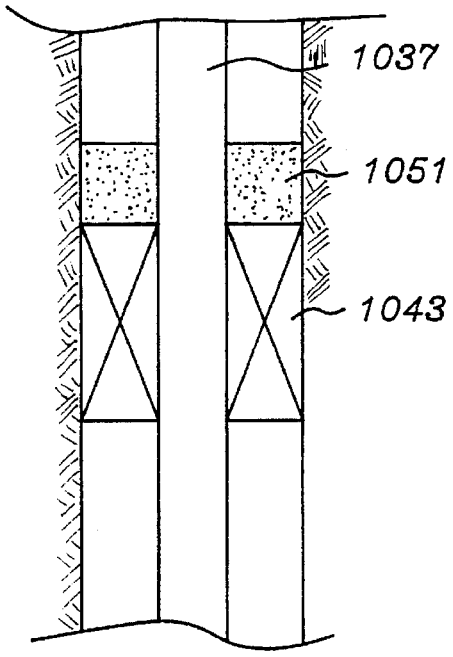
Figure 10I:
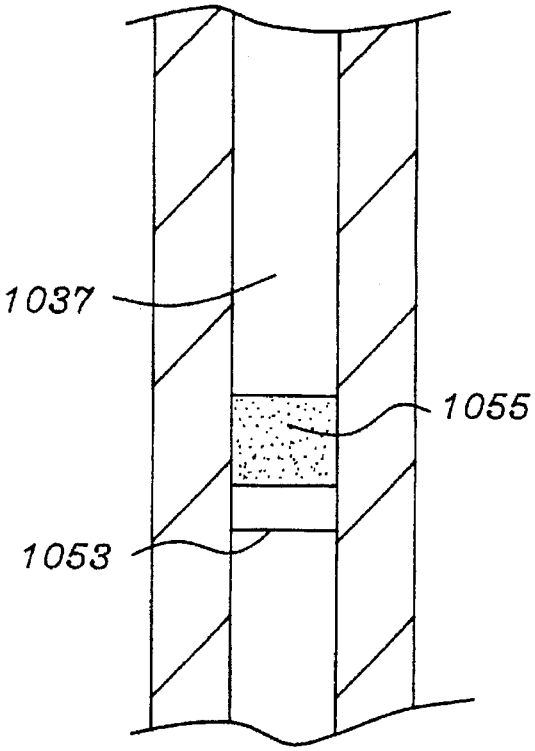

In FIG. 10G, production tubing string 1037 is shown in a fixed position relative to casing string 1045, with packer 1043 set to locate, stabilize, and seal, as is conventional. As is shown perforations 1047 allow the inward flow of hydrocarbons and formation water, which are produced through valve assembly 1049 and lifted to the earth's surface utilizing either gas lift technology, sucker rod pumping devices, or submersible pumps, none of which are shown in this figure for purposes of simplicity and clarity. As is shown in FIG. 10H, a particulate matter pressure plug 1051 may be provided atop and adjacent to packer 1043 to supplement the transference and sealing action of packer 1043.

Figure 10J:
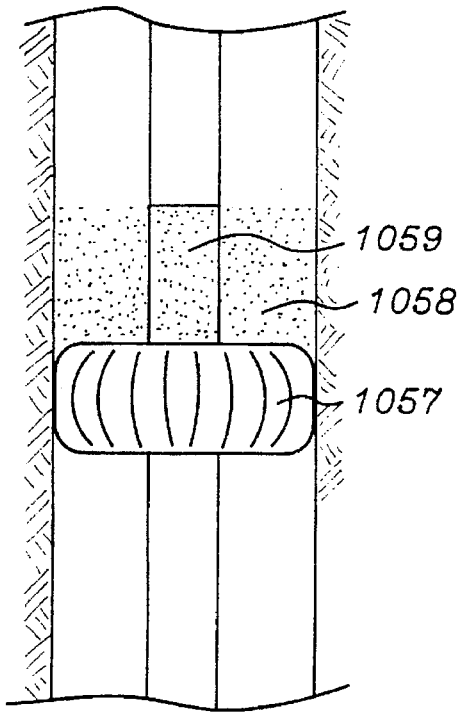
Figure 10K:
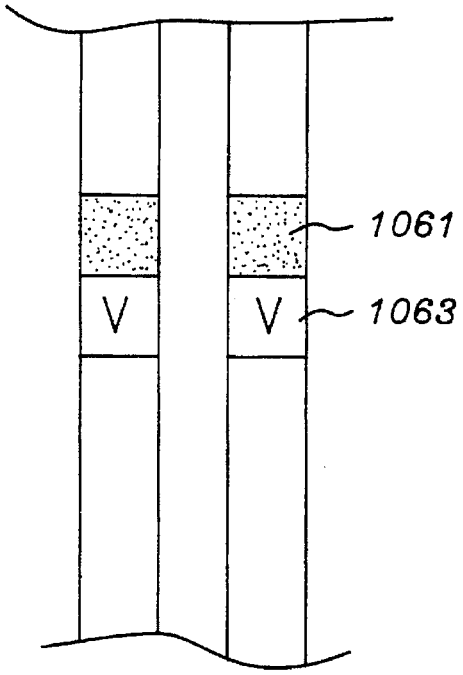

During certain operations, it is desirable to plug temporarily or permanently a tubular conduit, such as production tubing string 1037 of FIG. 101. As is shown, a temporary plug 1053 is located in the central bore of production tubing string 1037. The particulate matter pressure plug 1055 of the present invention may be provided above and adjacent the temporary or permanent plug to bolster the pressure differential which can be accommodated by plug 1053, and to supplement the sealing action of plug 1053. FIG. 10J shows an alternative use of the particulate matter pressure plug to bolster the load bearing and sealing action of bridge plug 1057. As is shown, particulate matter pressure plugs 1058, 1059 are located adjacent bridge plug 1057, and operates to increase the sealing and load transference capabilities of bridge plug 1057. In the view of FIG. 10K, particulate matter pressure plug 1061 is shown located adjacent annulus safety valve 1063, and may be utilized to bolster the sealing capability of annulus safety valve of 1063.

Figure 10L:
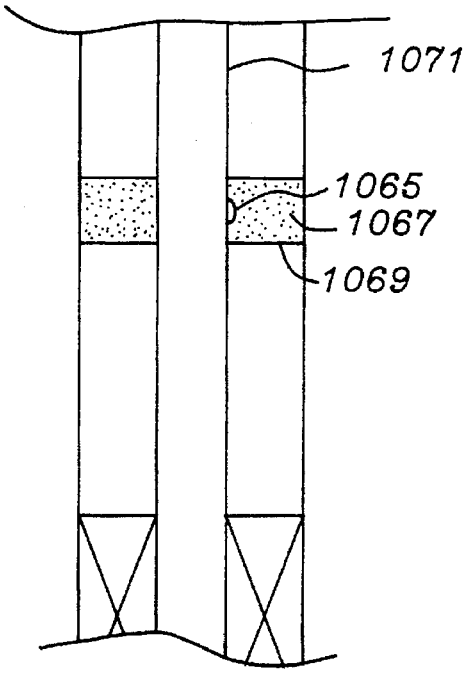

FIG. 10L depicts the utilization of the particulate matter pressure plug of the present invention to seal leaks within the tubular conduit, such as tubing string 1071. As is shown, a partition member 1069 is located adjacent leak 1065 and the particulate matter and binder is located there above and adjacent to leak 1065. The particulate matter pressure plug is utilized in this configuration primarily as a sealing device, and can obviate expensive workover operations which would ordinarily require the pulling of production tubing string 1071 in order to repair leak 1065.

Figure 10M:
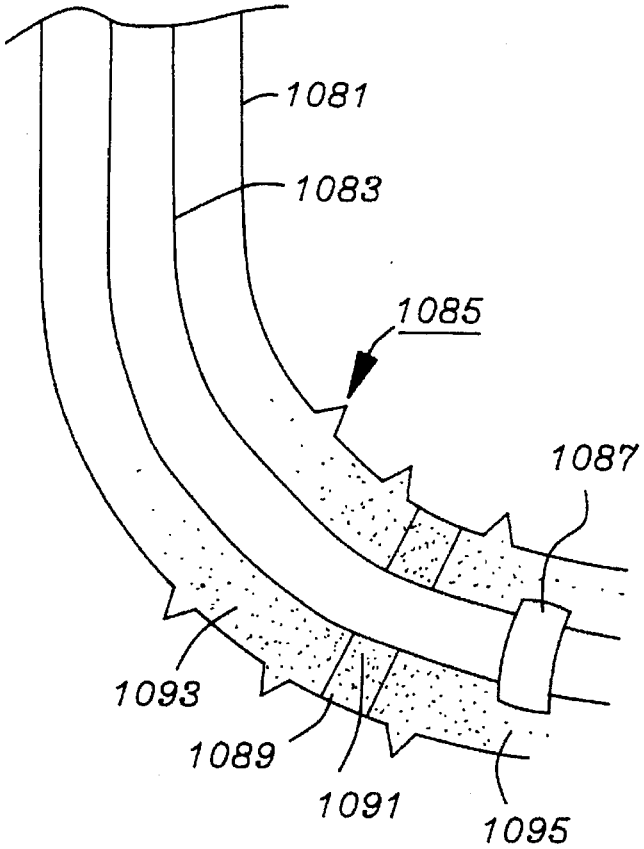
Figure 10N:
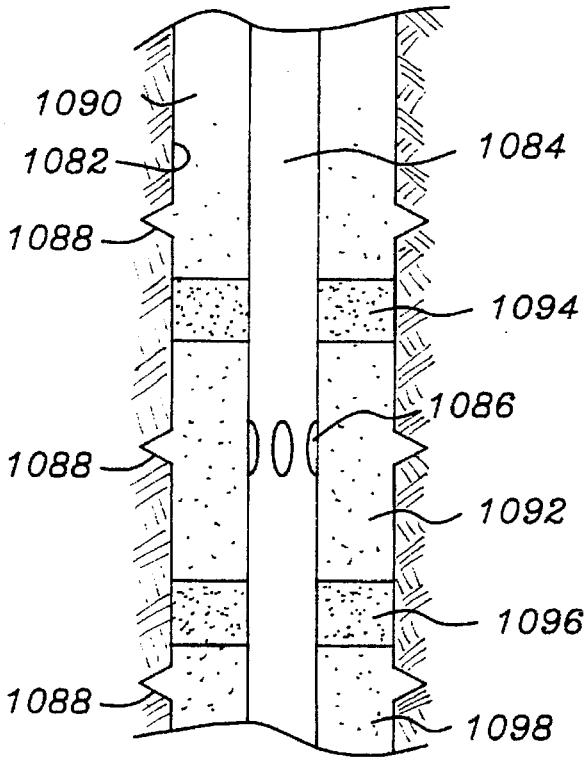

The particulate matter pressure plug of the present invention may also be used in flow control and gravel packing operations, as is depicted schematically in FIGS. 10M and 10N. FIG. 10M schematically depicts a completed wellbore 1081 with production tubing 1083 disposed therein. A plurality of perforations 1085 are provided to allow the flow of hydrocarbons into the wellbore. The production tubing string 1083 includes a gravel pack screen 1087 which allows wellbore fluids to flow into the production tubing string, but which prevents the flow of gravel pack material 1093 (such as sand, glass beads, or other particulate matter such as gravel) which has been intentionally placed into the wellbore and surrounding formation to check the inward flow of fine particulate matter such as sand, and to prevent the collapse or deterioration of the wellbore while the well is being produced.

The pressure particulate matter pressure plug 1089 of the present invention may be located in a predetermined position within the gravel pack to prevent or limit the flow of fluids between particular portions of the wellbore. If a complete restriction is desired, then the particulate matter is compacted sufficiently to form a fluid impermeable barrier; however, if a mere flow restriction is required, then the particulate matter is compacted to a lesser extend to allow for some limited flow through particulate matter pressure plug 1089. This technique is particularly useful when subsurface formations have differing pressure and production characteristics. The particulate matter pressure plug may be utilized to restrict or block flow between formations which have greatly differing pressures, for example. A plurality of the particulate matter pressure plugs may be located throughout the gravel pack to obtain particular flow and production goals.

Another utilization of the particulate matter pressure plug of the present invention is to obtain a flow objective. As is shown in FIG. 10N, production tubing string 1084 extends downward within 1082. A plurality of perforations 1088 are provided to allow the flow of wellbore fluids into the annular region. Production tubing string includes production valve 1086 which allows for the inward flow of wellbore fluids. As is shown in FIG. 10N, the annular region between production tubing string and wellbore 1082 is gravel packed with particulate, matter. As is shown, particulate matter pressure plug 1094 is provided to block or restrict the flow of fluids between annular regions 1090 and 1092. A second particulate matter pressure plug 1096 is provided to prevent or restrict the flow of wellbore fluids between annular regions 1092 and 1098. This may be especially useful if the formations above or below valve 1086 are low pressure zones, region of the wellbore surrounding valve 1086 is a high pressure zone. It may be beneficial to block the flow of fluids up and down the wellbore annulus in order to prevent a net loss of pressure from a high-pressure zone to a lower pressure zone.

The present invention can be characterized broadly as a method which includes three broad method steps. The first step is to convey a quantity of particulate matter to a particular wellbore location. Then, the particulate matter is contained at least temporarily in order to allow compaction. The third step is compaction and dehydration of the particulate matter in a manner which generates the useful force transference and sealing of the present invention. A variety of alternatives exists for the conveyance, containment, and compaction operations, each of which will be discussed herebelow. FIGS. 11A through 11I schematically depict a variety of conveyance and containment options available for the particulate matter pressure plug of the present invention.

Figure 11A:
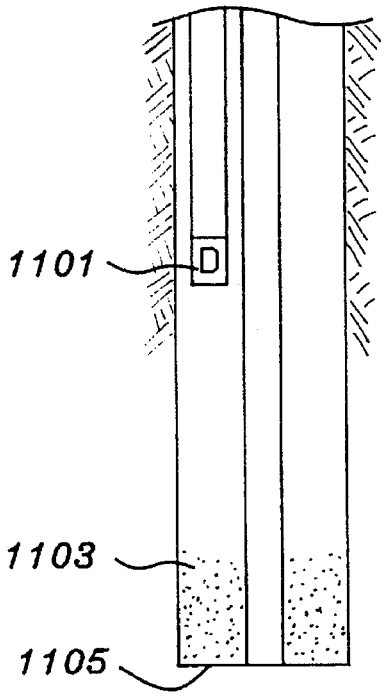
FIGS. 11A through 11L depict alternative techniques for effecting conveyance, containment, and compaction of the particulate matter in order to form a particulate matter pressure plug in accordance with the present invention.
Figure 11B:
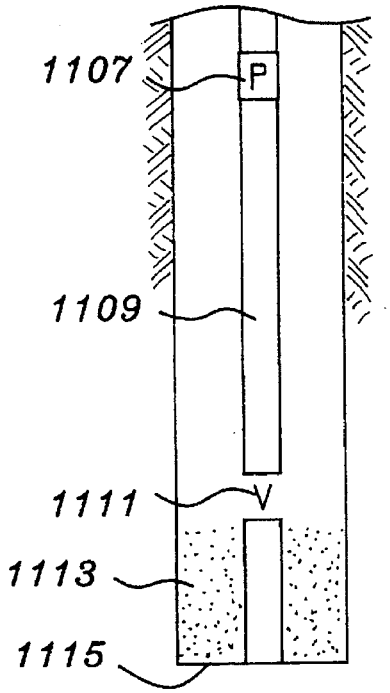
Figure 11C:
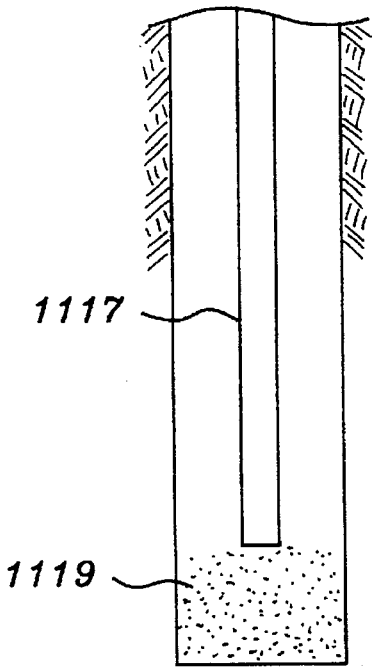
Figure 11D:
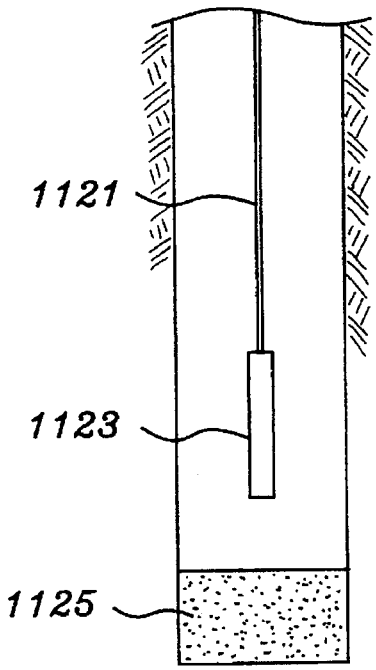
Figure 11E:
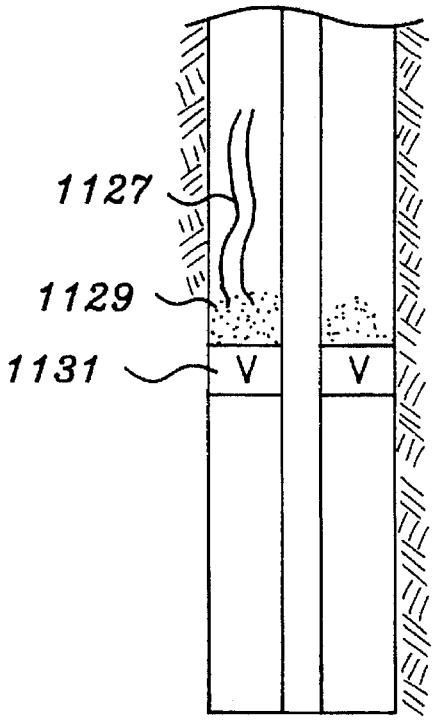
Figure 11F:
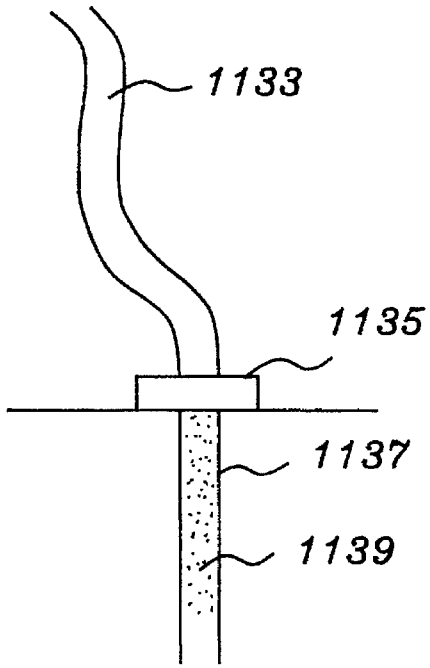
Figure 11G:
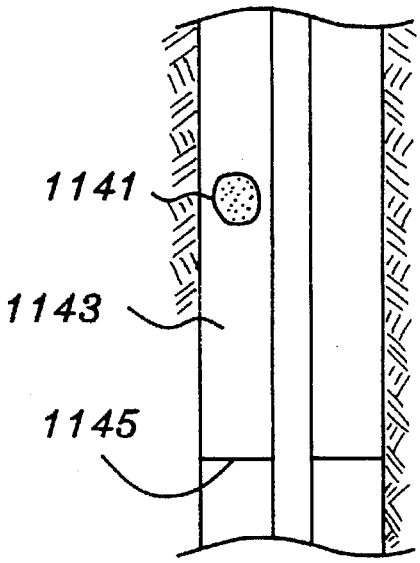
Figure 11H:
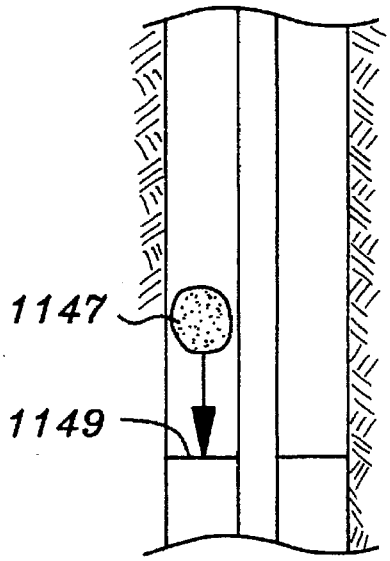
Figure 11I:
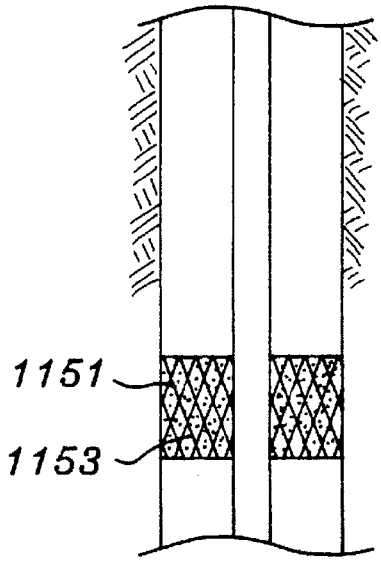
Figure 11J:
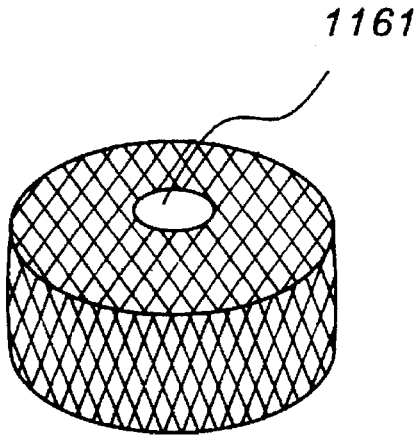

First with reference to FIG. 11A, a dump bailer 1101 may be utilized to dump the particulate matter in a wellbore fluid column either remotely from or adjacent a containment member 1105 in order to allow for the aggregation of particulate matter 1103 and formation of the particulate matter pressure plug of the present invention, preferably through application of force through a fluid column, but not necessarily so. FIG. 11B depicts the utilization of a pump 1107 which directs a slurry including the particulate matter through a wellbore conduit 1109 (such as a production tubing string) and a valve 1111 to locate particulate matter 1113 adjacent containment barrier 1115. In FIG. 11C, the utilization of a coiled tubing string 1117 is depicted to locate particulate matter 1119 adjacent a wellbore barrier or containment member. In FIG. 11D, an electrical wireline 1121 is depicted energizing an electrically actuable pumping and dumping device 1123 which deposits particulate matter 1125 adjacent a containment barrier in order to form the particulate matter pressure plug of the present invention. FIG. 11E depicts the utilization of a hydraulic control line 1127 to deposit particulate matter 1129 adjacent a wellbore barrier such as safety valve 1131. FIG. 11F depicts the utilization of an offshore umbilical 1133 to deposit particulate matter below subsurface wellhead 1135 to locate particulate matter 1139 in a subsurface conduit 1137 adjacent a containment barrier or member. FIG. 11G depicts the utilization of an elastomeric balloon-type conveyance device which loaded with particulate matter weighted, and dropped within a wellbore fluid column where it eventually ruptures and deposits the particulate matter adjacent a containment barrier 1145 in a particular location 1143. FIG. 11H schematically depicts the utilization of a fluid-permeable sack or containment 1147 which is loaded with particulate matter and a binder, and which is pumped down or gravity-driven downward within a particular fluid column to be located adjacent a containment barrier member 1149. FIG. 11I depicts utilization of a mesh or wire basket 1151 which may be filled with particulate matter and lowered to a particular location within a wellbore for formation of the pressure plug of the present invention. FIG. 11J is a perspective view of one type of wire mesh basket which may be constructed in accordance with the present invention. As is shown, in this particular embodiment, the basket is cylindrical in shape, and includes a central bore 1161 which allows the basket to ride to a particular location along the exterior surface of a particular wellbore conduit. Preferably, the basket is formed of a wire having a mesh size which is sufficient to contain all or most of the particulate matter which is loaded therein. Force is applied to the particulate matter through the wire mesh container by application of a high pressure fluid column thereto in order to form a load transferring and sealing particulate matter pressure plug.

Figure 11K:
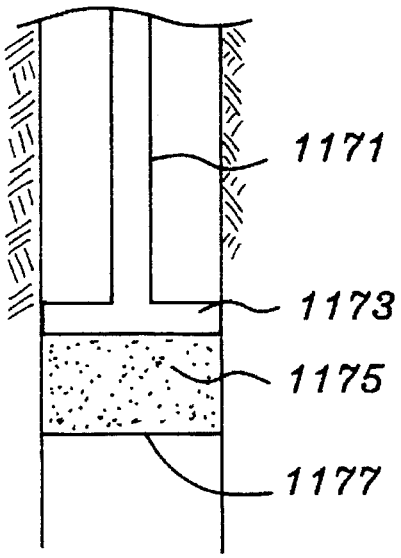
Figure 11L:
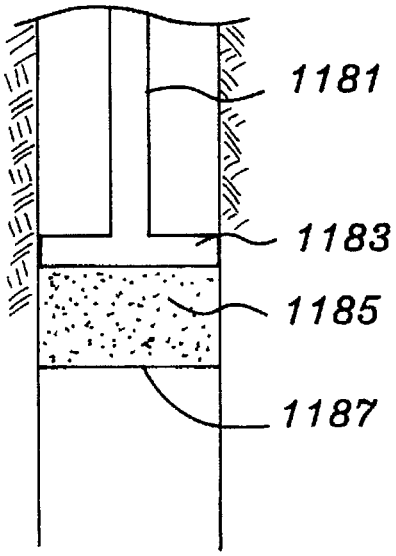

FIGS. 11K and 11L depict two alternative techniques for compacting and dehydrating the particulate matter pressure plug of the present invention. FIG. 11K depicts the utilization of an axial loading device which perceives an axial load and applies it through piston head 1173 to particulate matter 1175 to compress it against containment member 1177. An alternative technique is depicted in FIG. 11L. This technique involves the initiation of a chemical reaction to generate gas from combustive or explosive material 1181, which acts on movable piston component 1183 which is urged downward to compress particulate matter 1185 against containment member 1187.

One significant advantage of the present invention is that the particulate matter pressure plug is substantially unaffected by high wellbore temperatures, unlike many wellbore tools which include elastomeric components and in particular wellbore tools which include elastomeric sealing components. The particulate matter pressure plug of the present invention may be used either in lieu of, or in support of, a conventional wellbore tool, and may be directly exposed to regions of the wellbore which are particularly high-temperature regions. The particulate matter pressure plug of the present invention is also advantageous with respect to the prior art insofar as it is extremely low in cost. The particulate matter pressure plug of the present invention is further advantageous over the prior art in that it is easy to locate and remove the particulate matter as compared to mechanical wellbore tools which are difficult to repair or replace.

While the invention has been shown in only one of its forms, it is not thus limited, but is susceptible to various changes and modifications without departing from the scope thereof.

What is claimed is:

1. A load-bearing apparatus for use in a wellbore having a wellbore surface defined therein, comprising:

a containment member for locating particulate matter in said wellbore; and a plug member located adjacent said containment member, composed at least partially of compacted, and at least partially drained, particulate matter, for laterally transferring a selected amount of force to said wellbore surface.

2. The load-bearing apparatus according to claim 1 wherein said particulate matter comprises at least one type of particulate material.

3. The load-bearing apparatus according to claim 1 wherein said particulate matter comprises:

a mixture including at least:

(a) a first component having particles of a first selected average dimension; and (b) a second component having particles of a second selected average dimension.

4. The load-bearing apparatus according to claim 1 wherein said particulate matter comprises a selected mixture of a plurality of components of particulate material, each component defining a different and discrete average particle dimension, with said different and discrete average particle dimensions varying across a selected range of values.

5. The load-bearing apparatus according to claim 1, wherein said particulate matter includes at least one binder component which fills interstitial spaces between other components of said particulate matter.

6. A load-bearing apparatus for use in a wellbore with fluid being disposed in at least a portion of said wellbore, said wellbore having a wellbore surface defined therein, comprising:

a containment member for selectively, and at least partially, limiting passage of particulate matter;

a plug member located proximate said containment member, composed at least partially of compacted particulate matter, for laterally transferring force to said wellbore surface; and a drain member for removing said fluid from at least a portion of said plug member, at least during compaction, to allow compaction.

7. The load-bearing apparatus according to claim 6, wherein said drain member directs said fluid through said partition member.

8. The load-bearing apparatus according to claim 6, wherein said drain member is integral with said partition member.

9. The load-bearing apparatus according to claim 6, wherein said drain member removes said fluid from a region of said plug member which is adjacent said partition member.

10. The load-bearing apparatus according to claim 6, wherein said partition member comprises an inflatable packing element and said drain member defines a fluid flow path through said inflatable packing element.

11. The load-bearing apparatus according to claim 6, wherein said particulate matter includes at least one binder component which fills interstitial spaces between other components of said particulate matter.

12. The load-bearing apparatus according to claim 11, wherein said binder component enhances fluid impermeability of said plug member.

13. The load-bearing apparatus according to claim 11, wherein said binder component permits said particulate matter to generally continuously deform and reform into said plug member without failure of said plug member.

14. The load-bearing apparatus according to claim 11, wherein said binder component includes at least a colloidal hydrating material.

15. The load-bearing apparatus according to claim 11, wherein said binder component includes at least bentonite.

16. A load-bearing and scaling apparatus for use in a wellbore, comprising:

a plug member, composed at least partially of (a) a particulate matter which has been mechanically compacted and (b) a binder component for filling interstitial spaces in said particulate matter;

which is operable in a plurality of operating modes, including:

(a) a plug member formation mode of operation wherein said particulate matter and said binder component are delivered to a selected location and compacted to form said plug member;

(b) a force-transference and sealing mode of operation, wherein (12) force is transferred laterally through said plug member and (2) at least a portion of said particulate matter defines a relatively fluid-impermeable barrier.

17. The load-bearing and sealing apparatus according to claim 16, wherein, during said plug member formation mode of operation, said particulate matter and said binder component are delivered to said selected location in slurry form.

18. The load-bearing and sealing apparatus according to claim 16, wherein, during said plug member formation mode of operation, fluid is drained from at least a portion of said plug member.

19. The load-bearing and sealing apparatus according to claim 16, wherein during said plug member formation mode of operation, compression of said particulate matter and said binder component causes said binder component to fill interstitial spaces between particles of said particulate matter.

20. The load-bearing and sealing apparatus according to claim 16, wherein, during said plug member formation mode of operation, compression of said particulate matter and said binder component results in development of regions in said plug member of differing fluid permeabilities.

21. The load-bearing and sealing apparatus according to claim 16, wherein, during said plug formation mode of operation, compression of said particulate matter and said binder component causes formation of said plug member with at least one region defining a relatively substantially fluid-impermeable region which is in contact with wellbore fluids.

22. A method of forming a pressure plug in a wellbore, comprising the method steps of:

forming a mixture of a plurality of types of particulate material;

depositing said mixture of said plurality of types of particulate material adjacent a selected wellbore structure;

compacting said plurality of types of particulate material into a plug by applying force thereto; and draining fluid from at least a portion of said plug during at least compaction.

23. A method of transferring axial force in a wellbore from a fluid column to a wellbore surface, comprising the method steps of:

delivering a mass of particulate material to a particular location in said wellbore;

applying said axial force from said fluid column to said mass of particulate material causing mechanical compaction of said mass of particulate material and reducing fluid permeability of said mass of particulate material; and transferring through said mass of particulate material a selected amount of axial force to said wellbore surface.

24. A method of transferring axial force according to claim 23, further comprising:

reversibly binding said mass of particulate material together with a binding component.

25. A method of transferring axial force according to claim 24, further comprising:

filling interstitial spaces in said mass of particulate material with said binding component.

26. A method of transferring axial force according to claim 23, further comprising:

filling interstitial spaces in said mass of particulate material with a hydrating component.

27. A method of transferring axial force according to claim 23, further comprising:

removing said mass of particulate material from said wellbore by applying a high pressure fluid stream thereto.

28. A method of transferring axial force according to claim 23, further comprising:

disintegrating said mass of particulate material by applying a removal fluid thereto; and removing said mass of particulate material, in slurry form, from said wellbore.

29. The method of transferring axial force according to claim 23, further comprising:

removing fluid from said mass of particulate material during compaction.

30. A method of transferring loads in a wellbore, comprising the method steps of:

conveying a quantity of particulate matter to a predetermined wellbore location;

containing said particulate matter;

compacting said particulate matter;

utilizing said particulate matter to transfer laterally a preselected amount of force in said wellbore.

31. A method of transferring loads according to claim 30, further including:

dehydrating at least a portion of said particulate matter; and sealing a flow path in said wellbore with said particulate matter.

32. A method of sealing in a wellbore, comprising the method steps of:

conveying a quantity of particulate matter to a predetermined wellbore location;

containing said particulate matter;

compacting said particulate matter;

dehydrating at least a portion of said particulate matter; and sealing a flow path in said wellbore with said particulate matter.

33. A method of sealing in a wellbore, according to claim 32, further including:

utilizing said particulate matter to transfer laterally a preselected amount of force in said wellbore.

34. A method of completing an oil and gas wellbore, comprising the method steps of:

providing a tubular string;

providing a plurality of completion tools;

locating selected ones of said plurality of completion tools in preselected locations on said tubular string;

lowering said tubular string into said wellbore;

utilizing selected ones of said plurality of completion tools to perform at least one of (1) transfer loads within said wellbore, and (2) seal fluid flow paths within said wellbore;

conveying a quantity of particulate matter to a predetermined wellbore location;

at least temporarily containing said quantity of particulate matter to a predetermined wellbore location;

compacting said quantity of particulate matter;

utilizing said quantity of particulate matter to perform at least one of (1) transfer load within said wellbore, and (2) seal fluid flow paths within said wellbore.

35. A method of completing an oil and gas wellbore, according to claim 34:

wherein said quantity of particulate matter is utilized to transfer load within said wellbore in order to perform at least one of the following completion operation tasks:

(1) anchor at least one wellbore component in place;
(2) plug at least one pathway;
(3) secure a tubular conduit in a particular position;
(4) block at least one leak path; and
(5) pack one wellbore component to another wellbore component.

36. A method of completing an oil and gas wellbore, according to claim 34:

wherein said quantity of particulate matter is conveyed within said wellbore utilizing at least one of:

(1) gravity;
(2) a fluid pump;
(3) coiled tubing;
(4) an electric line delivery mechanism;
(5) a control line; and
(6) an umbilical.

37. A method of completing an oil and gas wellbore, according to claim 34:

wherein said quantity of particulate matter is contained utilizing at least one of:

(1) a fluid permeable membrane;
(2) a rupturable container; and
(3) a mesh housing.

* * * * *